US009183998B2

(12) United States Patent
Elick et al.

(10) Patent No.: US 9,183,998 B2
(45) Date of Patent: Nov. 10, 2015

(54) TAP CHANGER HAVING AN IMPROVED VACUUM INTERRUPTER ACTUATING ASSEMBLY

(71) Applicants: Robert Alan Elick, Jackson, TN (US); David Matthew Geibel, Jackson, TN (US)

(72) Inventors: Robert Alan Elick, Jackson, TN (US); David Matthew Geibel, Jackson, TN (US)

(73) Assignee: ABB Technology AG, Zürich (CH)

( * ) Notice: Subject to any disclaimer, the term of this patent is extended or adjusted under 35 U.S.C. 154(b) by 0 days.

(21) Appl. No.: 14/036,875

(22) Filed: Sep. 25, 2013

(65) Prior Publication Data

US 2015/0047955 A1 Feb. 19, 2015

Related U.S. Application Data

(63) Continuation-in-part of application No. PCT/US2012/030187, filed on Mar. 22, 2012.

(60) Provisional application No. 61/467,859, filed on Mar. 25, 2011.

(51) Int. Cl.

| | |
|---|---|
| ***H01H 19/00*** | (2006.01) |
| ***H01H 21/00*** | (2006.01) |
| ***H01H 9/00*** | (2006.01) |
| ***H01H 3/30*** | (2006.01) |
| *H01H 3/60* | (2006.01) |

(52) U.S. Cl.

CPC ..... *H01H 9/0038* (2013.01); *H01H 3/30* (2013.01); *H01H 9/0027* (2013.01); *H01H 3/3015* (2013.01); *H01H 3/605* (2013.01)

(58) Field of Classification Search

CPC . H01H 3/3015; H01H 9/0027; H01H 9/0038; H01H 3/605; H01H 33/6661; H01H 3/30; H01H 9/0016; H01H 9/0044

USPC ..... 200/11 TC; 218/140

See application file for complete search history.

(56) References Cited

U.S. PATENT DOCUMENTS

| | | | |
|---|---|---|---|
| 3,396,248 | A | 8/1968 | Wilson, Jr. |
| 3,421,073 | A | 1/1969 | Perkins |
| 3,553,395 | A | 1/1971 | White |
| 3,852,553 | A | 12/1974 | Lingenfelter et al. |

(Continued)

FOREIGN PATENT DOCUMENTS

| | | | |
|---|---|---|---|
| WO | 2012134958 | A1 | 10/2012 |
| WO | 2012134963 | A1 | 10/2012 |
| WO | 2012134977 | A1 | 10/2012 |

OTHER PUBLICATIONS

EP0355814, Yokohashi, Published Feb. 1990 (in English) and 6 pages of Figures.*

(Continued)

*Primary Examiner* — Kyung Lee
(74) *Attorney, Agent, or Firm* — Paul R. Katterle

(57) ABSTRACT

An on-load tap changer is provided having a vacuum interrupter actuatable by a shaft. A movable shuttle is connected to an impact mass by springs such that the impact mass tends to follow the shuttle when the shuttle moves. A pawl assembly is operable to hold and then release the impact mass when the shuttle starts moving. The holding of the impact mass when the shuttle starts to move causes the springs to store both a compression force and a tension force, which are released when the impact mass is released.

18 Claims, 16 Drawing Sheets

(56) References Cited

U.S. PATENT DOCUMENTS

| | | | | |
|---|---|---|---|---|
| 5,034,578 | A * | 7/1991 | Lauterwald | 200/11 B |
| 5,056,377 | A | 10/1991 | Yatchum et al. | |
| 5,107,200 | A | 4/1992 | Dohnal et al. | |
| 5,165,295 | A | 11/1992 | Dohnal et al. | |
| 5,191,179 | A | 3/1993 | Yatchum et al. | |
| 5,266,759 | A | 11/1993 | Dohnal et al. | |
| 5,877,465 | A | 3/1999 | Perret | |
| 6,060,669 | A | 5/2000 | Dohnal et al. | |
| 6,347,615 | B1 | 2/2002 | Höpfl et al. | |
| 7,842,122 | B2 | 11/2010 | Golner et al. | |
| 8,207,457 | B2 * | 6/2012 | Twibell et al. | 200/11 TC |
| 2003/0168433 | A1 | 9/2003 | Kurzmann | |
| 2005/0016962 | A1 | 1/2005 | Loebner et al. | |
| 2014/0176273 | A1 | 6/2014 | Elick et al. | |
| 2015/0047954 | A1 | 2/2015 | Elick et al. | |
| 2015/0061806 | A1 | 3/2015 | Elick et al. | |

OTHER PUBLICATIONS

Maschinenfabrik Reinhausen, "On-Load Tap-Changer RMV-A 600 A / 1320 A", 2161246/00EN.F0209700• TL8001.03, May 2010, Regensburg, Germany.

* cited by examiner

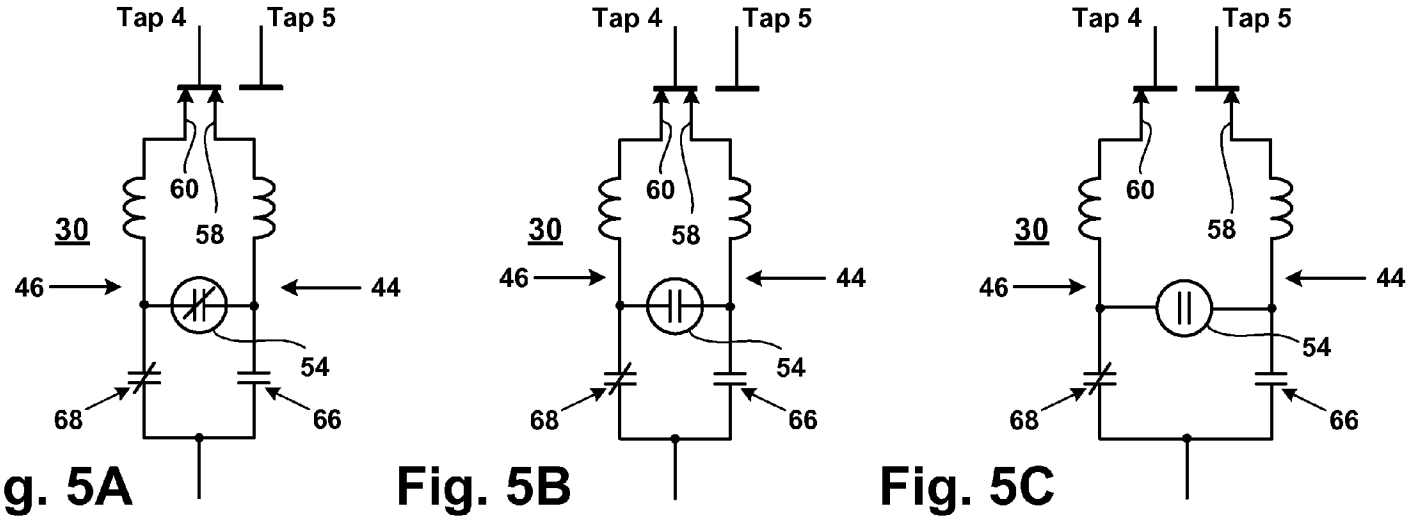
Fig. 5A
Fig. 5B
Fig. 5C
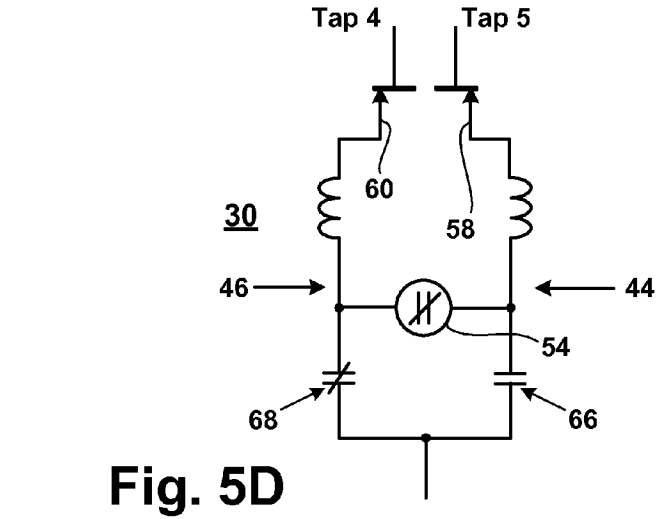
Fig. 5D
Fig. 5E

TAP CHANGER HAVING AN IMPROVED VACUUM INTERRUPTER ACTUATING ASSEMBLY

CROSS-REFERENCE TO RELATED APPLICATION

This application is a continuation-in-part application, under 35 U.S.C. §120, of copending PCT Patent Application No. PCT/US2012/030187, having an international filing date of Mar. 22, 2012, which claims the benefit of U.S. Provisional Application No. 61/467,859, filed on Mar. 25, 2011, each of which is hereby incorporated by reference in its entirety.

BACKGROUND OF THE INVENTION

This invention relates to tap changers and more particularly to load tap changers.

As is well known, a transformer converts electricity at one voltage to electricity at another voltage, either of higher or lower value. A transformer achieves this voltage conversion using a primary winding and a secondary winding, each of which are wound on a ferromagnetic core and comprise a number of turns of an electrical conductor. The primary winding is connected to a source of voltage and the secondary winding is connected to a load. Voltage present on the primary winding is induced on the secondary winding by a magnetic flux passing through the core. By changing the ratio of secondary turns to primary turns, the ratio of output to input voltage can be changed, thereby controlling or regulating the output voltage of the transformer. This ratio can be changed by effectively changing the number of turns in the primary winding and/or the number of turns in the secondary winding. This is accomplished by making connections between different connection points or "taps" within the winding(s). A device that can make such selective connections to the taps is referred to as a "tap changer".

Generally, there are two types of tap changers: on-load tap changers and de-energized or "off-load" tap changers. An off-load tap changer uses a circuit breaker to isolate a transformer from a voltage source and then switches from one tap to another. An on-load tap changer (or simply "load tap changer") switches the connection between taps while the transformer is connected to the voltage source. A load tap changer may include, for each phase winding, a selector switch assembly, a bypass switch assembly and a vacuum interrupter assembly. The selector switch assembly makes connections to taps of the transformer, while the bypass switch assembly connects the taps, through two branch circuits, to a main power circuit. During a tap change, the vacuum interrupter assembly safely isolates a branch circuit. A drive system moves the selector switch assembly, the bypass switch assembly and the vacuum interrupter assembly. The operation of the selector switch assembly, the bypass switch assembly and the vacuum interrupter assembly are interdependent and carefully choreographed. The present invention is directed toward a tap changer having an improved vacuum interrupter actuating assembly.

SUMMARY OF THE INVENTION

In accordance with the present invention, an on-load tap changer is provided having a vacuum interrupter assembly for immersion in a dielectric fluid. The vacuum interrupter assembly includes a vacuum interrupter with contacts and a rotatable cam. A shaft is connected to the contacts of the vacuum interrupter and is operable upon movement to open and close the contacts. A shuttle is provided having a cam follower engaged with the cam such that rotation of the cam moves the shuttle. An impact mass is connected to the shuttle by first and second springs such that the impact mass tends to follow the shuttle when the shuttle moves. A holding device is operable to hold and then release the impact mass when the shuttle starts to move. The holding of the impact mass when the shuttle starts to move causes the one of the first and second springs to extend and the other one of the first and second springs to compress and store a compression force, which is released when the impact mass is released. During the movement of the impact mass, the impact mass contacts the shaft and moves the shaft to open or close the contacts.

BRIEF DESCRIPTION OF THE DRAWINGS

The features, aspects, and advantages of the present invention will become better understood with regard to the following description, appended claims, and accompanying drawings where:

FIG. 5A shows the electrical circuit in a first stage of a tap change in which a first bypass switch is opened;

FIG. 5B shows the electrical circuit in a second stage of the tap change in which a vacuum interrupter is opened;

FIG. 5C shows the electrical circuit in a third stage of the tap change in which a first contact arm is moved to a new tap;

FIG. 5D shows the electrical circuit in a fourth stage of the tap change in which the vacuum interrupter is closed;

FIG. 5E shows the electrical circuit in a fifth stage of the tap change in which the first bypass switch is closed;

DETAILED DESCRIPTION OF ILLUSTRATIVE EMBODIMENTS

Figure 1:
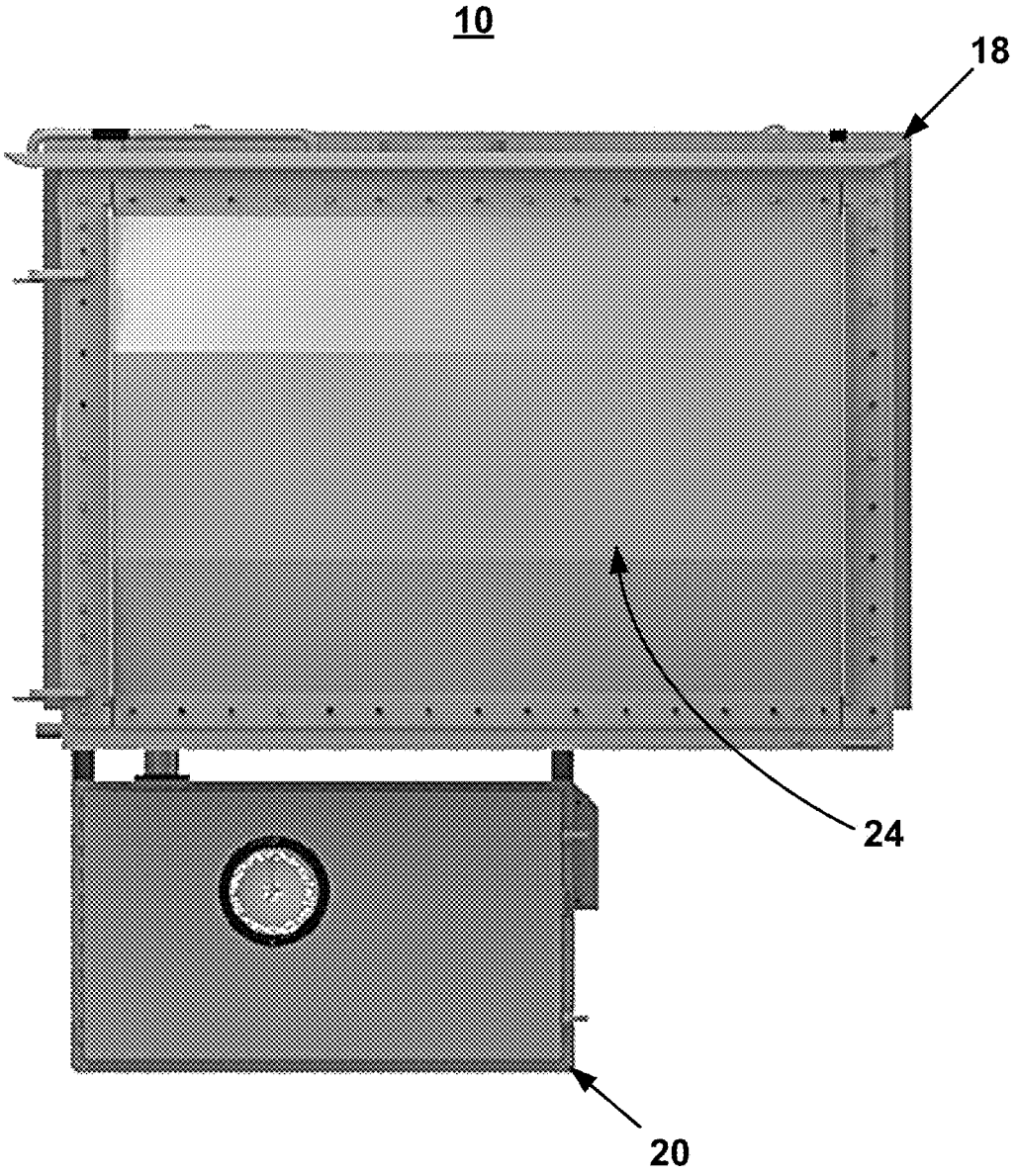
FIG. 1 shows a front elevational view of a tap changer of the present invention.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Figure 2:
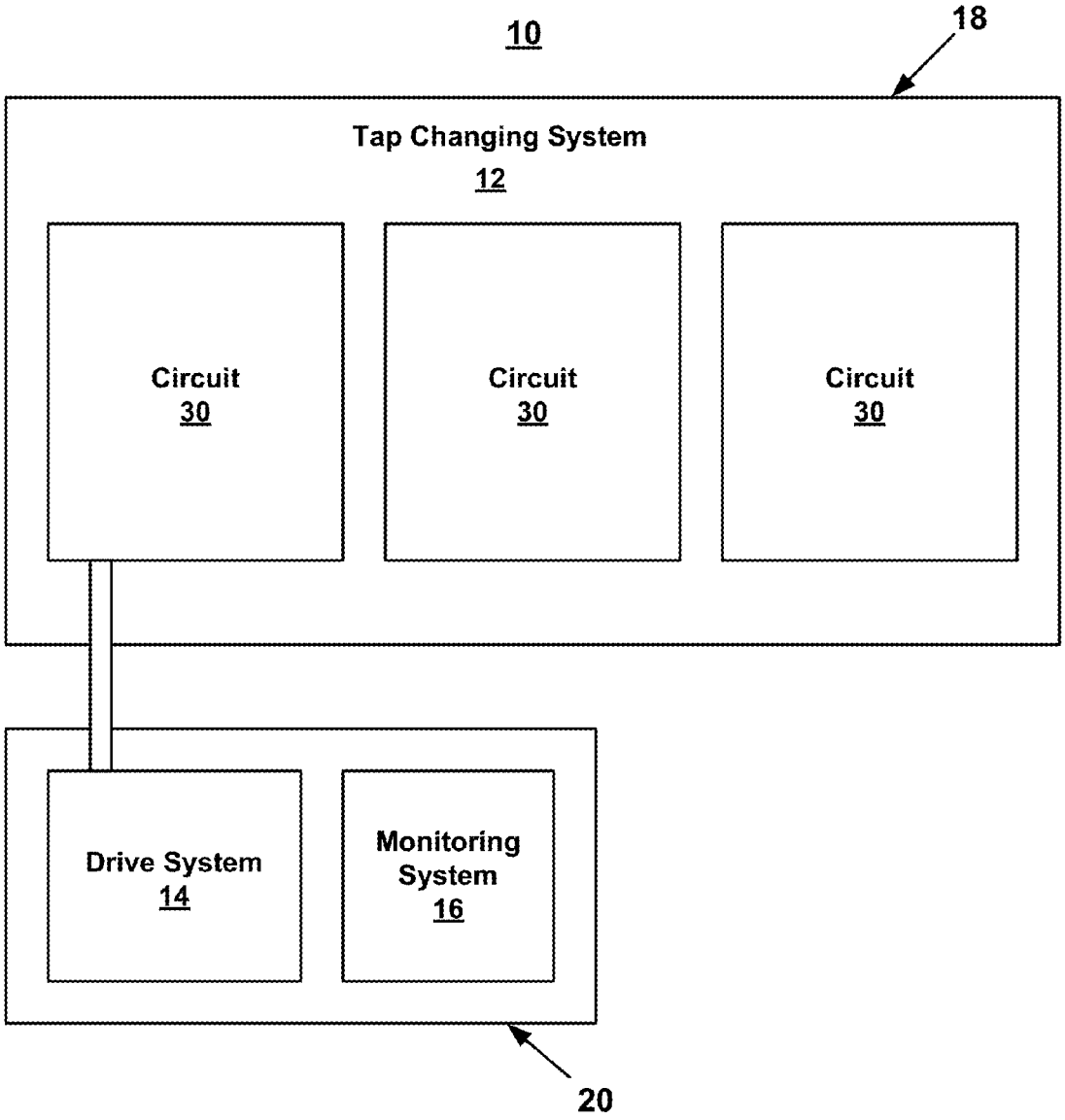
FIG. 2 shows a schematic view of the tap changer.

Referring now to FIGS. 1 and 2, there is shown a load tap changer (LTC) 10 embodied in accordance with the present invention. The LTC 10 is adapted for on-tank mounting to a transformer. Generally, the LTC 10 comprises a tap changing assembly 12, a drive system 14 and a monitoring system 16. The tap changing assembly 12 is enclosed in a tank 18, while the drive system 14 and the monitoring system 16 are enclosed in a housing 20, which may be mounted below the tank 18. The tank 18 defines an inner chamber within which the tap changing assembly 12 is mounted. The inner chamber holds a volume of dielectric fluid sufficient to immerse the tap changing assembly 12. Access to the tap changing assembly 12 is provided through a door 24, which is pivotable between open and closed positions.

Figure 3A:
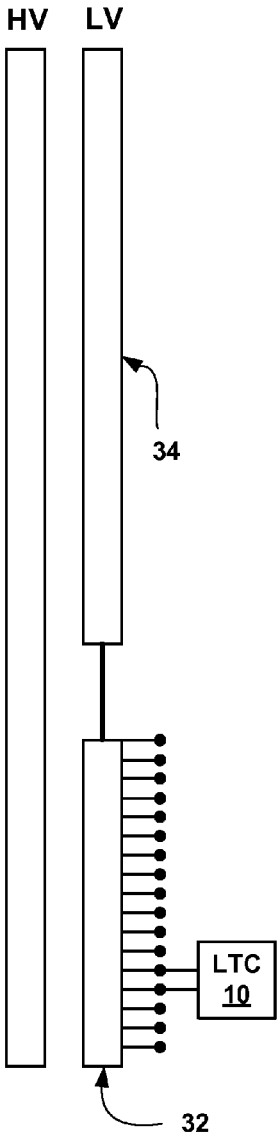
FIG. 3A shows a circuit diagram of the tap changer in a linear configuration.
Figure 3B:
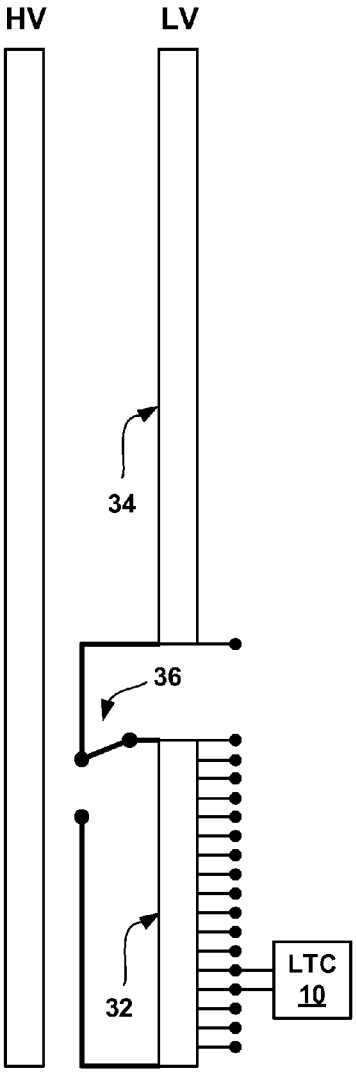
FIG. 3B shows a circuit diagram of the tap changer in a plus-minus configuration.
Figure 3C:
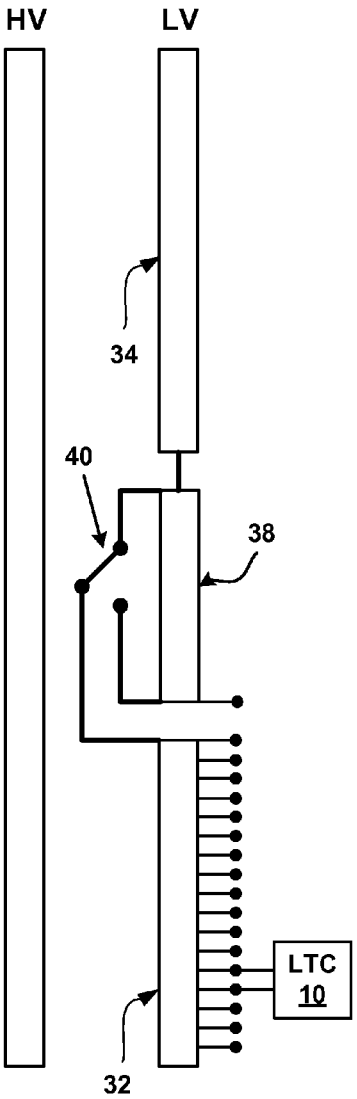
FIG. 3C shows a circuit diagram of the tap changer in a coarse-fine configuration.

The tap changing assembly 12 includes three circuits 30, each of which is operable to change taps on a regulating winding 32 for one phase of the transformer. Each circuit 30 may be utilized in a linear configuration, a plus-minus configuration or a coarse-fine configuration, as shown in FIGS. 3A, 3B, 3C respectively. In the linear configuration, the voltage across the regulating winding 32 is added to the voltage across a main (low voltage) winding 34. In the plus-minus configuration, the regulating winding 32 is connected to the main winding 34 by a change-over switch 36, which permits the voltage across the regulating winding 32 to be added or subtracted from the voltage across the main winding 34. In the coarse-fine configuration, there is a coarse regulating winding 38 in addition to the (fine) regulating winding 32. A change-over switch 40 connects the (fine) regulating winding 32 to the main winding 34, either directly, or in series, with the coarse regulating winding 38.

Figure 4:
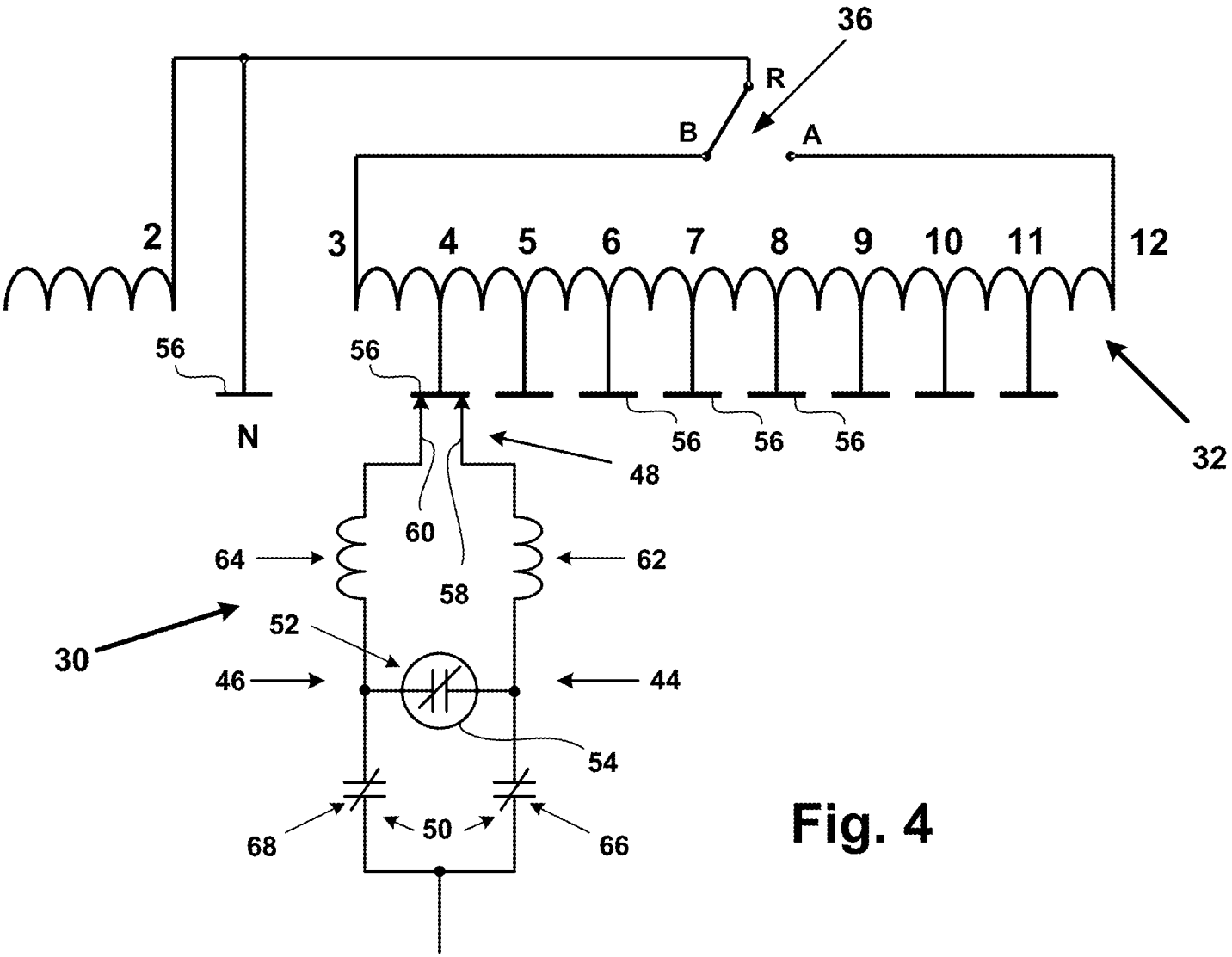
FIG. 4 shows a schematic drawing of an electrical circuit of the tap changer.

Referring now to FIG. 4, there is shown a schematic drawing of one of the electrical circuits 30 of the tap changing assembly 12 connected to the regulating winding 32 in a plus-minus configuration. The electrical circuit 30 is arranged into first and second branch circuits 44, 46 and generally includes a selector switch assembly 48, a bypass switch assembly 50 and a vacuum interrupter assembly 52 comprising a vacuum interrupter 54.

Figure 10:
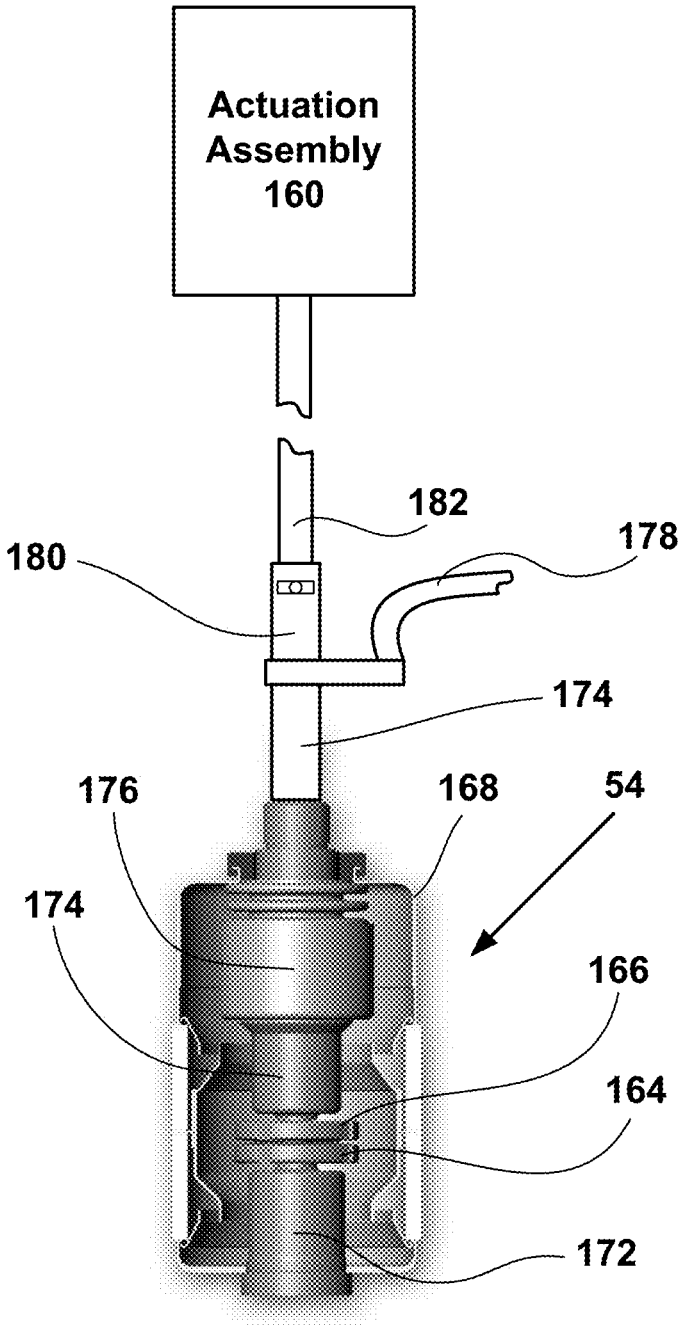
FIG. 10 shows a sectional view of a vacuum interrupter of the vacuum interrupter assembly.

The selector switch assembly 48 comprises movable first and second contact arms 58, 60 and a plurality of stationary contacts 56 which are connected to the taps of the winding 32, respectively. The first and second contact arms 58, 60 are connected to reactors 62, 64, respectively, which reduce the amplitude of the circulating current when the selector switch assembly 48 is bridging two taps. The first contact arm 58 is located in the first branch circuit 44 and the second contact arm 60 is located in the second branch circuit 46. The bypass switch assembly 50 comprises first and second bypass switches 66, 68, with the first bypass switch 66 being located in the first branch circuit 44 and the second bypass switch 68 being located in the second branch circuit 46. Each of the first and second bypass switches 66, 68 is connected between its associated reactor and the main power circuit. The vacuum interrupter 54 is connected between the first and second branch circuits 44, 46 and comprises a fixed contact 164 and a movable contact 166 enclosed in a bottle or housing 168 having a vacuum therein, as is best shown in FIG. 10.

The first and second contact arms 58, 60 of the selector switch assembly 48 can be positioned in a non-bridging position or a bridging position. In a non-bridging position, the first and second contact arms 58, 60 are connected to a single one of a plurality of taps on the winding 32 of the transformer. In a bridging position, the first contact arm 58 is connected to one of the taps and the second contact 60 is connected to another, adjacent one of the taps.

In FIG. 4, the first and second contact arms 58, 60 are both connected to tap 4 of the winding 32, i.e., the first and second contact arms 58, 60 are in a non-bridging position. In a steady state condition, the contacts 164, 166 of the vacuum interrupter 54 are closed and the contacts in each of the first and second bypass switches 66, 68 are closed. The load current flows through the first and second contact arms 58, 60 and the first and second bypass switches 66, 68. Substantially no current flows through the vacuum interrupter 54 and there is no circulating current in the reactor circuit.

A tap change in which the first and second contact arms 58, 60 are moved to a bridging position will now be described with reference to FIGS. 5A-5E. The first bypass switch 66 is first opened (as shown in FIG. 5A), which causes current to flow through the vacuum interrupter 54 from the first contact arm 58 and the reactor 62. The vacuum interrupter 54 is then opened to isolate the first branch circuit 44 (as shown in FIG. 5B). This allows the first contact arm 58 to next be moved to tap 5 without arcing (as shown in FIG. 5C). After this move, the vacuum interrupter 54 is first closed (as shown in FIG. 5D) and then the first bypass switch 66 is closed (as shown in FIG. 5E). This completes the tap change. At this point, the first contact arm 58 is connected to tap 5 and the second contact arm 60 is connected to tap 4, i.e., the first and second contact arms 58, 60 are in a bridging position. In a steady state condition, the contacts 164, 166 of the vacuum interrupter 54 are closed and the contacts in each of the first and second bypass switches 66, 68 are closed. The reactors 62, 64 are now connected in series and the voltage at their midpoint is one half of the voltage per tap selection. Circulating current now flows in the reactor circuit.

Another tap change may be made to move the second contact arm 60 to tap 5 so that the first and second contact arms 58, 60 are on the same tap (tap 5), i.e., to be in a non-bridging position. To do so, the above-described routine is performed for the second branch circuit 46, i.e, the second bypass switch 68 is first opened, then the vacuum interrupter 54 is opened, the second contact arm 60 is moved to tap 5, the vacuum interrupter 54 is first closed and then the second bypass switch 68 is closed.

In the tap changes described above, current flows continuously during the tap changes, while the first and second contact arms 58, 60 are moved in the absence of current.

As best shown in FIG. 4, the selector switch assembly 48 may have eight stationary contacts 56 connected to eight taps on the winding 32 and one stationary contact 56 connected to a neutral (mid-range) tap of the winding 32. Thus, with the change-over switch 36 on the B terminal (as shown), the selector switch assembly 48 is movable among a neutral position and sixteen discreet raise (plus) positions (i.e., eight non-bridging positions and eight bridging positions). With the change-over switch 36 on the A terminal, the selector switch assembly 48 is movable among a neutral position and sixteen discreet lower (minus) positions (i.e., eight non-bridging positions and eight bridging positions). Accordingly, the selector switch assembly 48 is movable among a total of 33 positions (one neutral position, 16 raise (R) positions and 16 lower (L) positions).

Figure 6:
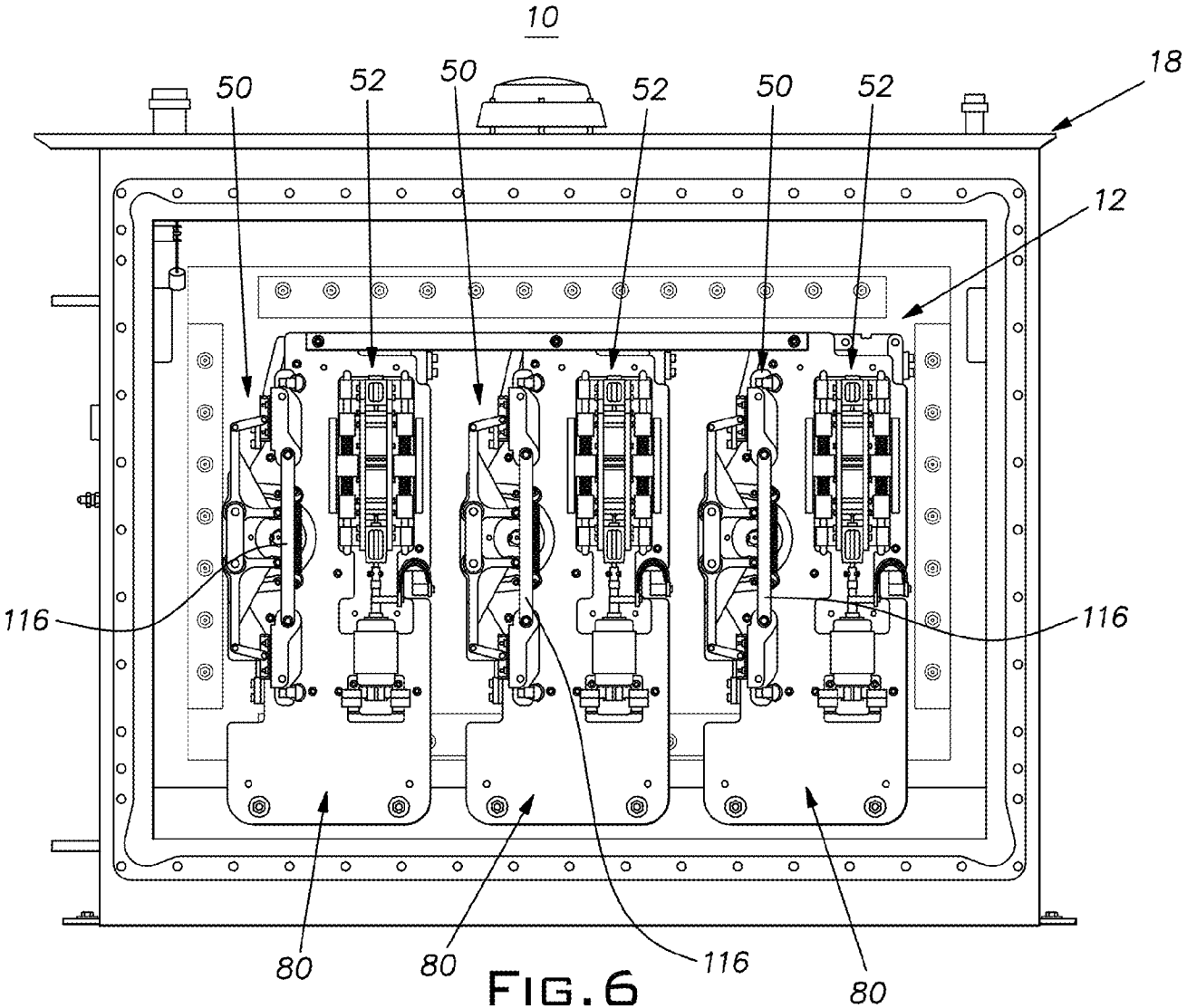
FIG. 6 shows a front view of the interior of a tank of the tap changer.

Referring now to FIG. 6, three support structures 80 are mounted inside the tank 18, one for each electrical circuit 30. The support structures 80 are composed of a rigid, dielectric material, such as fiber-reinforced dielectric plastic. For each electrical circuit 30, the bypass switch assembly 50 and the vacuum interrupter assembly 52 are mounted on a first (or front) side of a support structure 80, while the selector switch assembly 48 is mounted behind the support structure 80.

Figure 7:
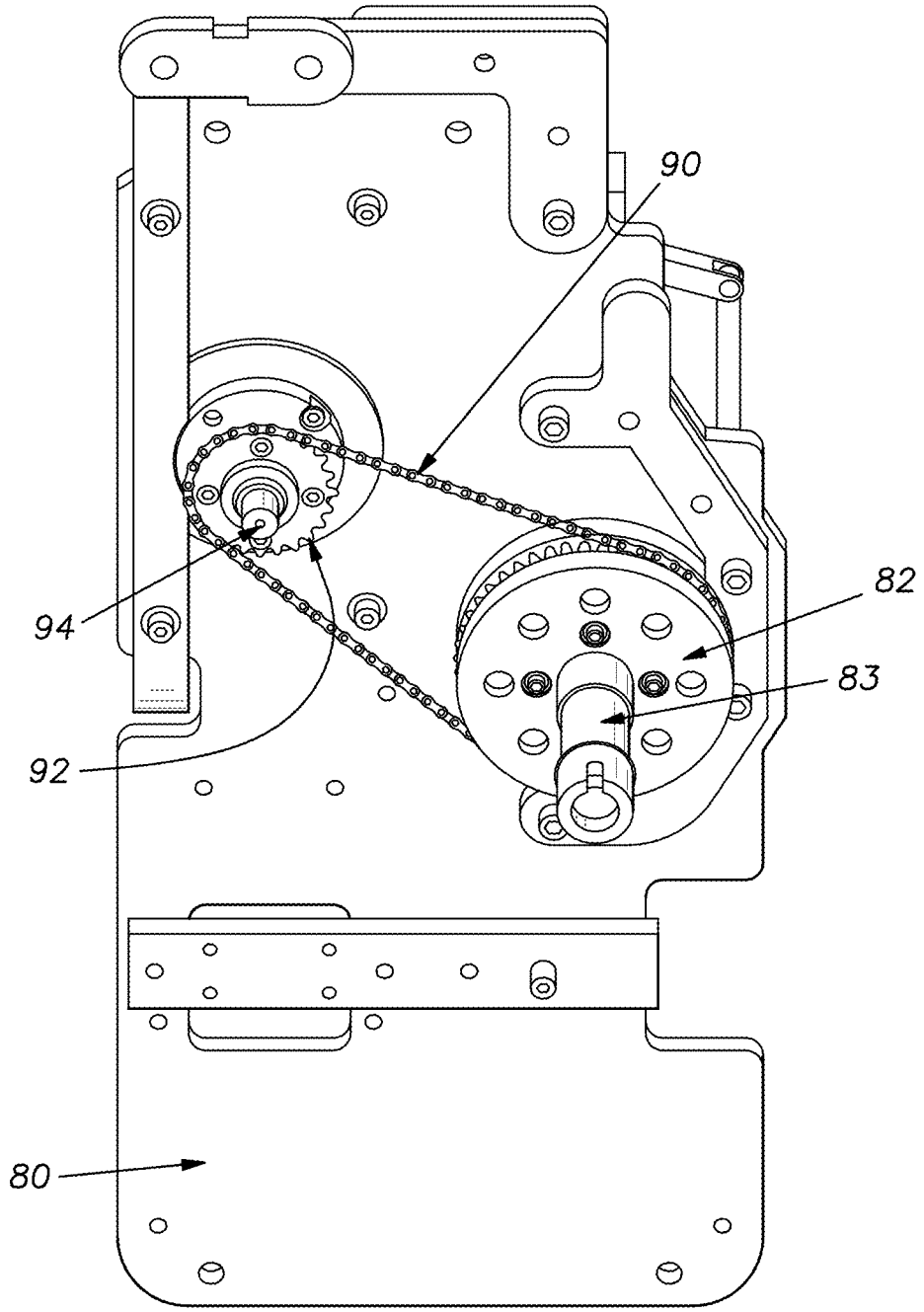
FIG. 7 shows a rear view of a front support structure of the tap changer.

Referring now to FIG. 7, the bypass switch assembly 50 includes a bypass gear 82 connected by an insulated shaft 83 to a transmission system, which, in turn, is connected to an electric motor. The bypass gear 82 is fixed to a bypass shaft that extends through the support structure 80 and into the first side of the support structure 80. The bypass gear 82 is connected by a chain 90 to a vacuum interrupter (VI) gear 92 secured on a VI shaft 94. The VI shaft 94 also extends through the support structure 80 and into the first side of the support structure 80. When the motor is activated to effect a tap change, the transmission system and the shaft 83 convey the rotation of a shaft of the motor to the bypass gear 82, thereby causing the bypass gear 82 and the bypass shaft to rotate. The rotation of the bypass gear 82, in turn, is conveyed by the chain 90 to the VI gear 92, which causes the VI gear 92 and the VI shaft 94 to rotate.

On the first side of the support structure 80, the bypass shaft is secured to a bypass cam 100, while the VI shaft 94 is secured to a VI cam 102. The bypass cam 100 rotates with the rotation of the bypass shaft and the VI cam 102 rotates with the rotation of the VI shaft 94. As will be described in more detail below, the bypass and VI gears 82, 92 are sized and arranged to rotate the bypass cam 100 through 180 degrees for each tap change and to rotate the VI cam 102 through 360 degrees for each tap change.

Figure 8:
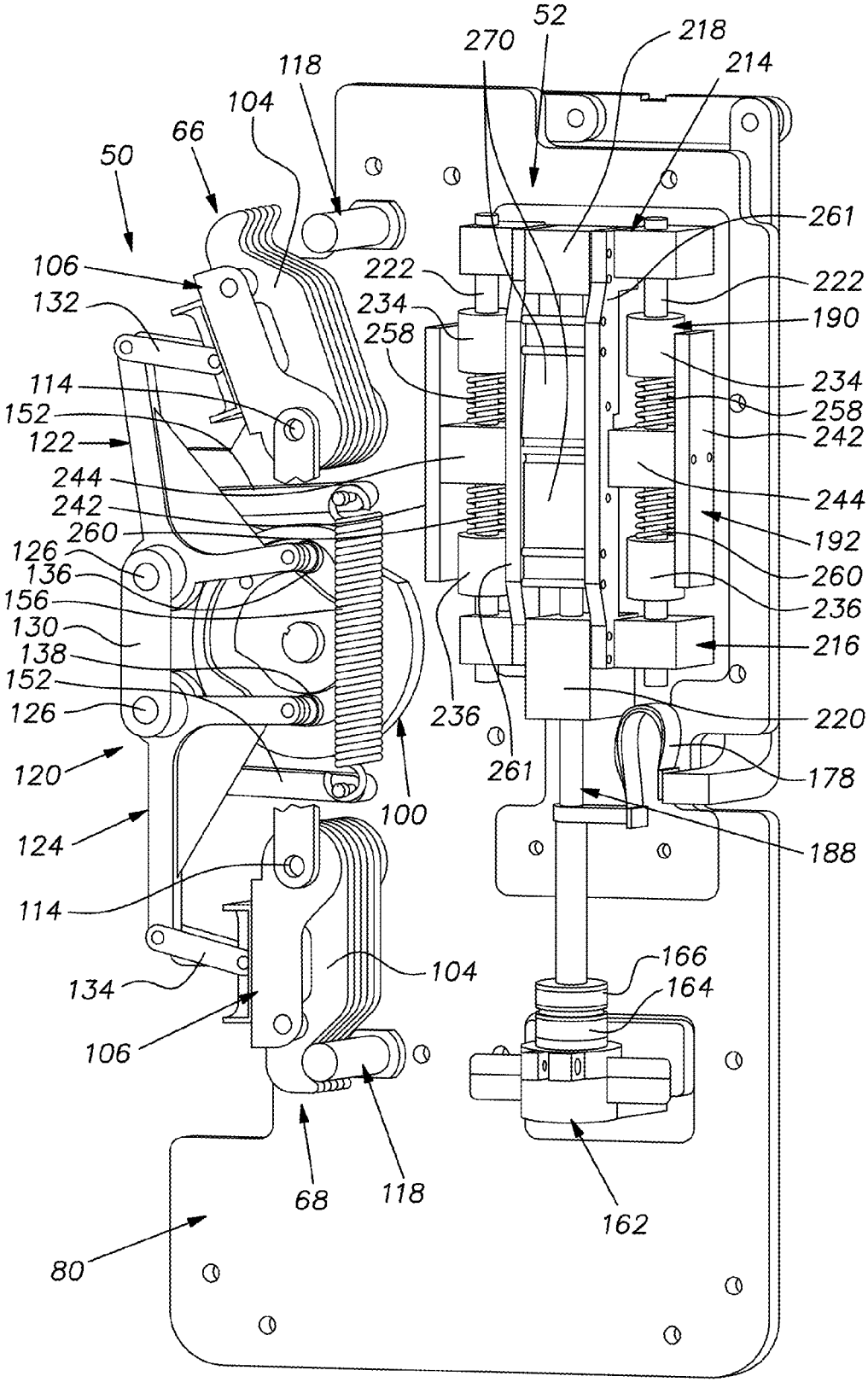
FIG. 8 shows a front perspective view of the support structure with a bypass switch assembly and a vacuum interrupter assembly mounted thereto.

Referring now to FIG. 8, the bypass switch assembly 50 includes the first and second bypass switches 66, 68, the bypass shaft and the bypass cam 100, as described above. Each of the first and second bypass switches 66, 68 comprises a plurality of contacts 104 arranged in a stack and held in a contact carrier 106. The contacts 104 are composed of a conductive metal, such as copper. Each contact 104 has a first or inner end and a second or outer end. A tapered notch (with a gradual V-shape) is formed in each contact 104 at the outer end, while a mounting opening extends through each contact 104 at the inner end. In each of the first and second contact switches 66, 68, when the contacts 104 are arranged in a stack, the tapered notches align to form a tapered groove. In addition, the mounting openings align to form a mounting bore extending through the switch. Each of the first and second bypass switches 66, 68 is pivotally mounted to the support structure 80 by a post 114 that extends through the mounting bore in the contacts 104, as well as aligned holes in the contact carrier 106 and a major tie bar 116 that extends between the first and second bypass switches 66, 68. The major tie bar 116 has been partially removed in FIG. 8 to better show other features. The entire major tie bar 116 can be seen in FIG. 6.

Each of the first and second bypass switches 66, 68 is movable between a closed position and an open position. In the closed position, a fixed contact post 118 is disposed in the groove and is in firm contact with the contacts 104. In the open position, the fixed contact post 118 is not disposed in the groove and the contacts 104 are spaced from the fixed contact post 118. The fixed contact posts 118 are both electrically connected to the main power circuit and, more specifically, to a neutral terminal. Each of the first and second bypass switches 66, 68 is moved between the closed and open positions by an actuation assembly 120.

The actuation assembly 120 is part of the bypass switch assembly 50 and comprises first and second bell cranks 122, 124. Each of the first and second bell cranks 122, 124 has a main connection point, a linkage connection point and a follower connection point, which are arranged in the configuration of a right triangle, with the main connection point being located at the right angle vertex. The first and second bell cranks 122, 124 are pivotally connected at their main connection points to the support structure by posts 126, respectively. The posts 126 extend through openings in the first and second bell cranks 122, 124 at the main connection points and through openings in the ends of a minor tie bar 130. A first end of a pivotable first linkage 132 is connected to the linkage connection point of the first bell crank 122 and a second end of the pivotable first linkage 132 is connected to the contact carrier 106 of the first bypass switch 66. Similarly, a first end of a pivotable second linkage 134 is connected to the linkage connection point of the second bell crank 124 and a second end of the pivotable second linkage 134 is connected to the contact carrier 106 of the second bypass switch 68. A wheel-shaped first cam follower 136 is rotatably connected to the follower connection point of the first bell crank 122, while a wheel-shaped second cam follower 138 is rotatably connected to the follower connection point of the second bell crank 124.

Figure 9:
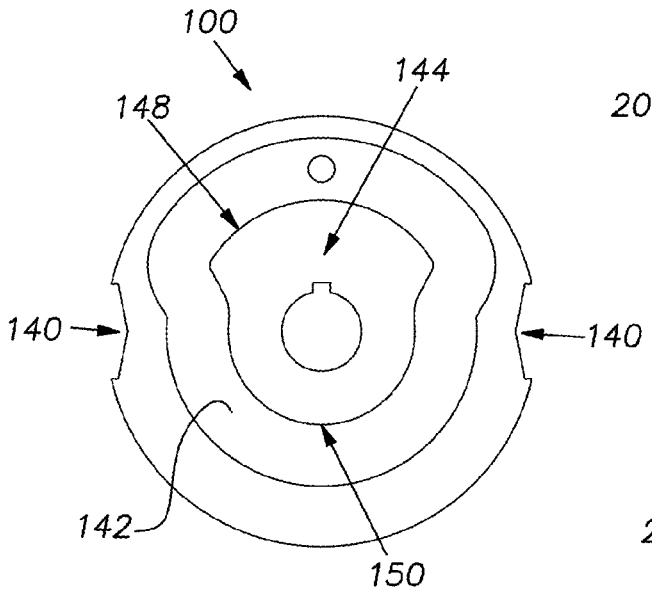
FIG. 9 shows a plan view of a bypass cam of the bypass switch assembly.

Referring now also to FIG. 9, the bypass cam 100 is generally circular and has opposing first and second major surfaces. A pair of enlarged indentations 140 may be formed in a peripheral surface of the bypass cam 100. The indentations 140 are located on opposing sides of the bypass cam 100 and have a nadir. The second major surface is flat and is disposed toward the support structure 80. The first major surface is disposed toward the door 24 (when it is closed) and has an endless, irregular groove 142 formed therein. The groove 142 is partly defined by a central area 144 having arcuate major and minor portions 148, 150. The major portion 148 has a greater radius than the minor portion 150. The transitions between the major and minor portions are tapered.

The first and second cam followers 136, 138 are disposed in the groove 142 on opposite sides of the central area 144. In a neutral or home position, the minor portion 150 of the bypass cam 100 is disposed toward the vacuum interrupter assembly 52, while the major portion 148 of the bypass cam 100 is disposed away from the vacuum interrupter assembly 52. In addition, the first and second cam followers 136, 138 are both in contact with the minor portion 150 at the junctures with the transitions to the major portion 148, respectively. With the first and second cam followers 136, 138 in these positions, both of the first and second bypass switches 66, 68 are in the closed position. When the bypass cam 100 is in the home position, the first and second contact arms 58, 60 are in a non-bridging position.

FIG. 8 shows the bypass cam 100 after it has rotated clockwise from its home, or neutral position in response to the initiation of a tap change. This rotation causes the first cam follower 136 to move (relatively speaking) through the transition and into contact with the major portion 148, while the second cam follower 138 simply travels over the minor portion 150. The movement of the first cam follower 136 through the transition increases the radius of the central area in contact with the first cam follower 136, thereby moving the first cam follower 136 outward. This outward movement, in turn, causes the first bell crank 122 to pivot counter-clockwise about the main connection point. This pivoting movement causes the first linkage 132 to pull the first bypass switch 66 outward, away from the fixed contact post 118, to the open position. As the first cam follower 136 moves over the major portion 148, the first bypass switch 66 is maintained in the open position. As the bypass cam 100 continues to rotate, the first cam follower 136 moves over the transition to the minor portion 150, thereby decreasing the radius of the central area 144 in contact with the first cam follower 136, which allows the first cam follower 136 to move inward and the first bell crank 122 to pivot clockwise. This pivoting movement causes the first linkage 132 to push the first bypass switch 66 inward, toward the fixed contact post 118, to the closed position. At this point, the tap change is complete and the bypass cam 100 has rotated 180 degrees to an intermediate position. The first and second cam followers 136, 138 are again both in contact with the minor portion 150 at the junctures with the transitions to the major portion 148, respectively, but the major portion 148 of the bypass cam 100 is now disposed toward the vacuum interrupter assembly 52, while the minor portion 150 of the bypass cam 100 is disposed away from the vacuum interrupter assembly 52. With the bypass cam 100 in this, intermediate position, both of the first and second bypass switches 66, 68 are again in the closed position. In addition, the first and second contact arms 58, 60 are in a bridging position.

If another tap change is made so that the second contact arm 60 is moved to the same tap as the first contact arm 58, i.e., a non-bridging position, the bypass cam 100 again rotates in the clock-wise direction, the second cam follower 138 moves through the transition and into contact with the major portion 148, while the first cam follower 136 simply travels over the minor portion 150. The movement of the second cam follower 138 through the transition increases the radius of the central area 144 in contact with the second cam follower 138, thereby moving the second cam follower 138 outward. This outward movement, in turn, causes the second bell crank 124 to pivot clockwise about the main connection point. This pivoting movement causes the second linkage 134 to pull the second bypass switch 68 outward, away from the fixed contact post 118, to the open position. As the second cam follower 138 moves over the major portion 148, the second bypass switch 68 is maintained in the open position. As the bypass cam 100 continues to rotate, the second cam follower 138 moves over the transition to the minor portion 150, thereby decreasing the radius of the central area 144 in contact with the second cam follower 138, which allows the second cam follower 138 to move inward and the second bell crank 124 to pivot counter-clockwise. This pivoting movement causes the second linkage 134 to push the second bypass switch 68 inward, toward the fixed contact post 118, to the closed position. At this point, the bypass cam 100 has rotated 360 degrees and the bypass cam 100 is back in the home position.

A pair of follower arms 152 may optionally be provided. The follower arms 152 are pivotally mounted to the support structure 80 and have rollers rotatably mounted to outer ends thereof, respectively. A spring 156 biases the outer ends of the follower arms 152 towards each other. This bias causes the rollers at the end of a tap change to move into the nadirs in the indentations 140. In this manner, the follower arms 152 are operable to bias the bypass cam 100 toward the home position and the intermediate position at the end of a tap change.

Referring now also to FIG. 10, the vacuum interrupter assembly 52 generally comprises the vacuum interrupter 54 and an actuation assembly 160.

The vacuum interrupter 54 is supported on and secured to a mount 162 that is fastened to the support structure 80. The vacuum interrupter 54 generally includes a fixed contact 164 and a movable contact 166 disposed inside a sealed bottle or housing 168. The housing 168 comprises a substantially cylindrical sidewall secured between upper and lower end cups so as form a hermetically sealed inner chamber, which is evacuated to about $10^{-5}$ Torr. The sidewall is composed of an insulating material such as a high-alumina ceramic material, a glass material or a porcelain material. The fixed and movable contacts 164, 166 are disc-shaped and may be of the butt-type. When the fixed and movable contacts 164, 166 are contacted together, they permit current to flow through the vacuum interrupter 54. The fixed contact 164 is electrically connected to a fixed electrode 172, which is secured to and extends through the lower end cup of the housing 168. The fixed electrode 172 is electrically connected to the mount 162, which, in turn, is electrically connected to the first branch circuit 44. The movable contact 166 is electrically connected to a movable electrode 174, which extends through the upper end cup of the housing 168 and is movable along a longitudinal axis relative to the fixed electrode 172. Upward movement of the movable electrode 174 opens the contacts 164, 166, while downward movement of the movable electrode 174 closes the contacts 164, 166. The relative motion of the movable electrode 174 is accomplished via a metal bellows structure 176, which is attached at one of its ends to the movable electrode 174 and at the other of its ends to the upper end cup.

A flexible metal strap 178 electrically connects the movable electrode 174 of the vacuum interrupter 54 to a bus bar of the second branch circuit 46. The metal strap 178 may be comprised of braided strands of wire. The metal strap 178 is secured to the movable electrode 174 by a swivel 180, which extends through a hole in an electrode of the metal strap 178 and is threadably received in a threaded bore of the movable electrode 174. A lower end of an interrupter shaft 182 is connected to the swivel 180 by a shoulder bolt. An upper end of the interrupter shaft 182 is threadably connected to a damper shaft 186. The swivel 180, the interrupter shaft 182 and the damper shaft 186 cooperate to form an actuation shaft 188.

Figure 18:
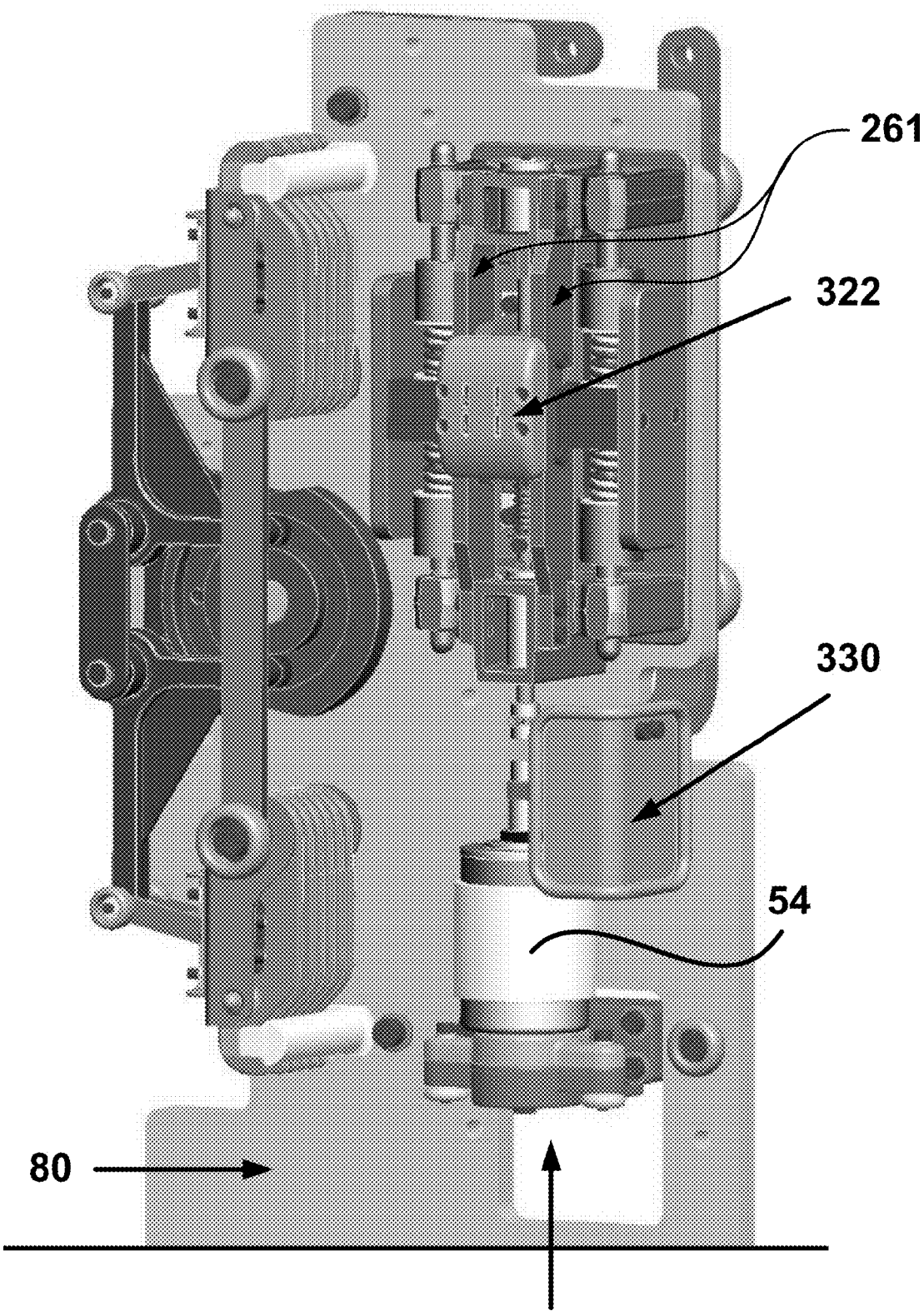
FIG. 18 shows a front perspective view of the support structure with a second embodiment of the vacuum interrupter assembly mounted thereto.

A dielectric shield 330 may be mounted to the bus bar of the second branch circuit 46, as shown in FIG. 18. The dielectric shield 330 extends over the metal strap 178 so as to be disposed between the metal strap 178 and the door 24. The dielectric shield 330 is composed of a conductive material, such as steel, and is at the same potential as the metal strap 178. Without the dielectric shield 330, if the metal strap 178 is damaged such that a strand of wire extends outward, toward the door 24, a very high magnitude electric field may be created at the loose end of the strand. Since the dielectric shield 330 is at the same potential as the metal strap 178, the dielectric shield reduces the magnitude of the electric field to a very low level.

The actuation assembly 160 generally comprises the VI cam 102, the actuation shaft 188, a shuttle 190, an impact mass 192, an unidirectional damper 194 and a contact erosion damper 196. Both the shuttle 190 and the impact mass 192 may be composed of metal, such as steel. The impact mass 192, however, is significantly heavier (has more mass) than the shuttle 190.

Figure 11:
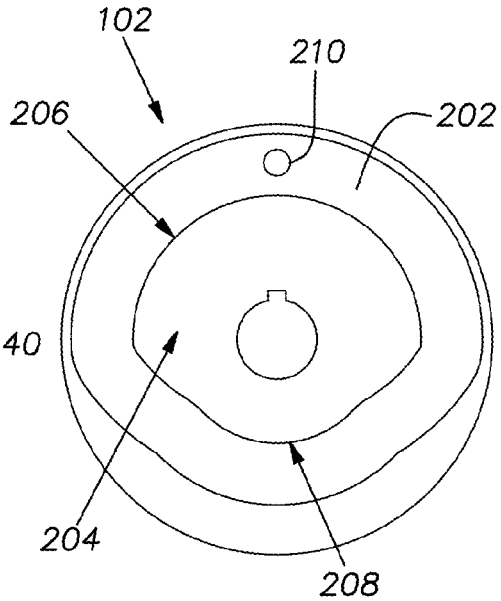
FIG. 11 shows a plan view of a vacuum interrupter cam of the vacuum interrupter assembly.

Referring now to FIG. 11, there is shown a front view of the VI cam 102. As shown, the VI cam 102 is substantially circular and has opposing first and second major surfaces. The second major surface is flat and is disposed toward the support structure 80. The first major surface is disposed toward the door 24 and has an endless, irregular groove 202 formed therein. The groove 202 is partly defined by a central area 204 having arcuate major and minor portions 206, 208. The major portion 206 has a greater radius than the minor portion 208. The transitions between the major and minor portions 206, 208 are tapered. A hole 210 extends through the VI cam 102 inside the groove 202 and is disposed at the center of the major portion 206.

Referring back to FIG. 8, upper and lower rail mounts 214, 216 are secured to the support structure 80 and are disposed above and below the VI cam 102, respectively. The upper rail mount 214 has a box-shaped central structure 218, and the lower rail mount 216 has a box-shaped central structure 220. Outer portions of the upper rail mount 214 hold upper ends of a pair of rails 222, while outer portions of the lower rail mount 216 hold lower ends of the rails 222. The rails 222 extend between the upper and lower rail mounts 214, 216 and bracket the VI cam 102. In this manner, the upper and lower rail mounts 214, 216 and the rails 222 surround the VI cam 102.

Figure 12:
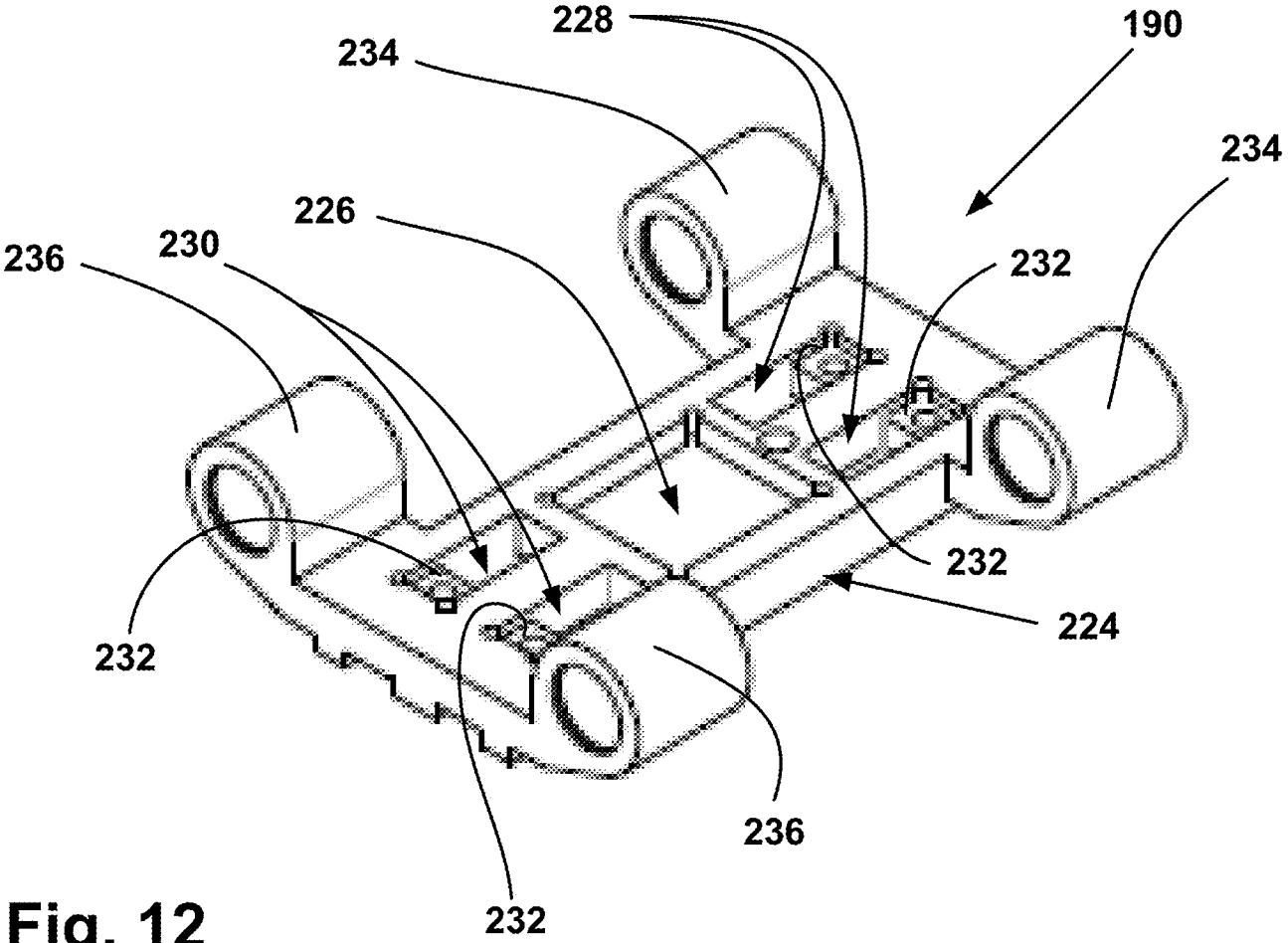
FIG. 12 shows a perspective view of a shuttle of the vacuum interrupter assembly.

The shuttle 190 is disposed over the VI cam 102. A second side of the shuttle 190 is disposed toward the VI cam 102, while a first side of the shuttle 190 is disposed toward the door 24 (when it is closed). The shuttle 190 is mounted to the rails 222 and is movable between the upper and lower rail mounts 214, 216. As shown in FIG. 12, the shuttle 190 has a rectangular body 224 with an enlarged central opening 226 disposed between a pair of upper openings 228 and a pair of lower openings 230. A pawl release plate 232 is secured in each of the upper and lower openings 228, 230. A cylindrical upper guide 234 and a cylindrical lower guide 236 are joined to each side of the body 224, with the upper guides 234 being located at the top of the body 224 and the lower guides 236 being located at the bottom of the body 224. Each of the upper and lower guides 234, 236 has a central bore extending therethrough. On each side of the shuttle 190, one of the rails 222 extends through the upper and lower guides 234, 236.

Figure 13:
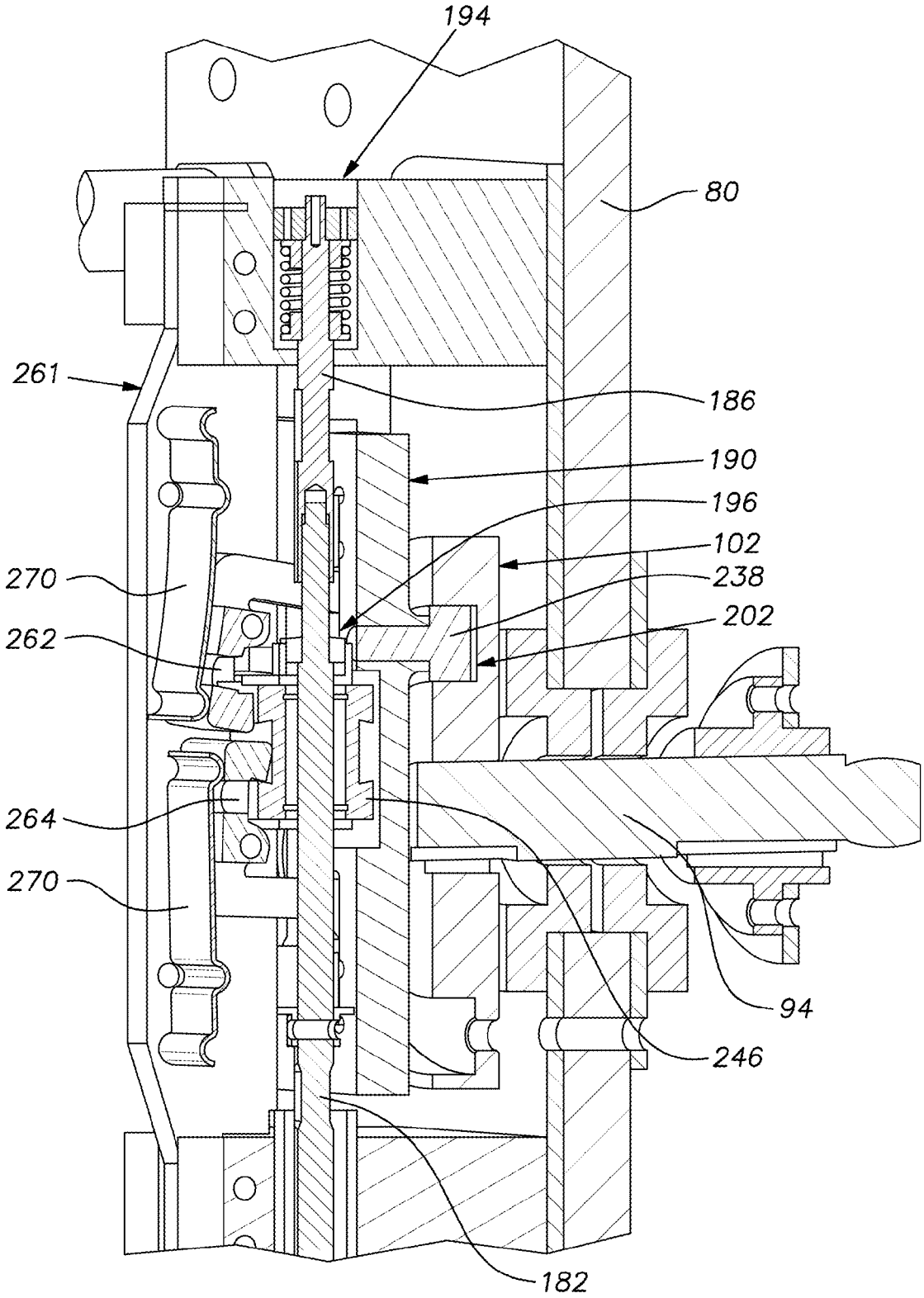
FIG. 13 shows a sectional view of a portion of the vacuum interrupter assembly showing the engagement of the shuttle with the vacuum interrupter cam.

Referring now to FIG. 13, a cam follower 238 is rotatably secured to the body 224 and projects from the second side of the shuttle 190. The cam follower 238 is disposed in the groove 202 of the VI cam 102. In a neutral or home position, the minor portion 208 of the VI cam 102 is disposed upward, while the major portion 206 of the VI cam 102 is disposed downward and the hole 210 is also disposed at its lowermost position. In addition, the cam follower 238 is in contact with the center of the minor portion 208. With the cam follower 238 in this position, the shuttle 190 is in its lowermost position and the contacts 164, 166 of the vacuum interrupter 54 are closed.

When the VI cam 102 is in the home position and a tap change is initiated, the VI cam 102 starts to rotate in a clockwise direction as viewed in FIG. 8. This rotation causes the cam follower 238 to move over half of the minor portion 208, through the transition and into contact with the major portion 206. The movement of the cam follower 238 through the transition increases the radius of the central area 204 in contact with the cam follower 238, thereby moving the cam follower 238 upward. This upward movement, in turn, causes the shuttle 190 to move upward to an uppermost position. As will be described more fully below, the upward movement of the shuttle 190 to the uppermost position causes the contacts 164, 166 of the vacuum interrupter 54 to open. As the cam follower 238 moves over the major portion 206, the shuttle 190 is maintained in the uppermost position (and the contacts 164, 166 of the vacuum interrupter 54 remain open). As the VI cam 102 continues to rotate, the cam follower 238 moves over the transition to the minor portion 208, thereby decreasing the radius of the central area 204 in contact with the cam follower 238, which allows the cam follower 238 and, thus the shuttle 190, to move downward. As will be described more fully below, the downward movement of the shuttle 190 to the lowermost or home position causes the contacts 164, 166 of the vacuum interrupter 54 to close. At this point, the tap change is complete and the VI cam 102 has rotated 360 degrees back to its home position.

Figure 14:
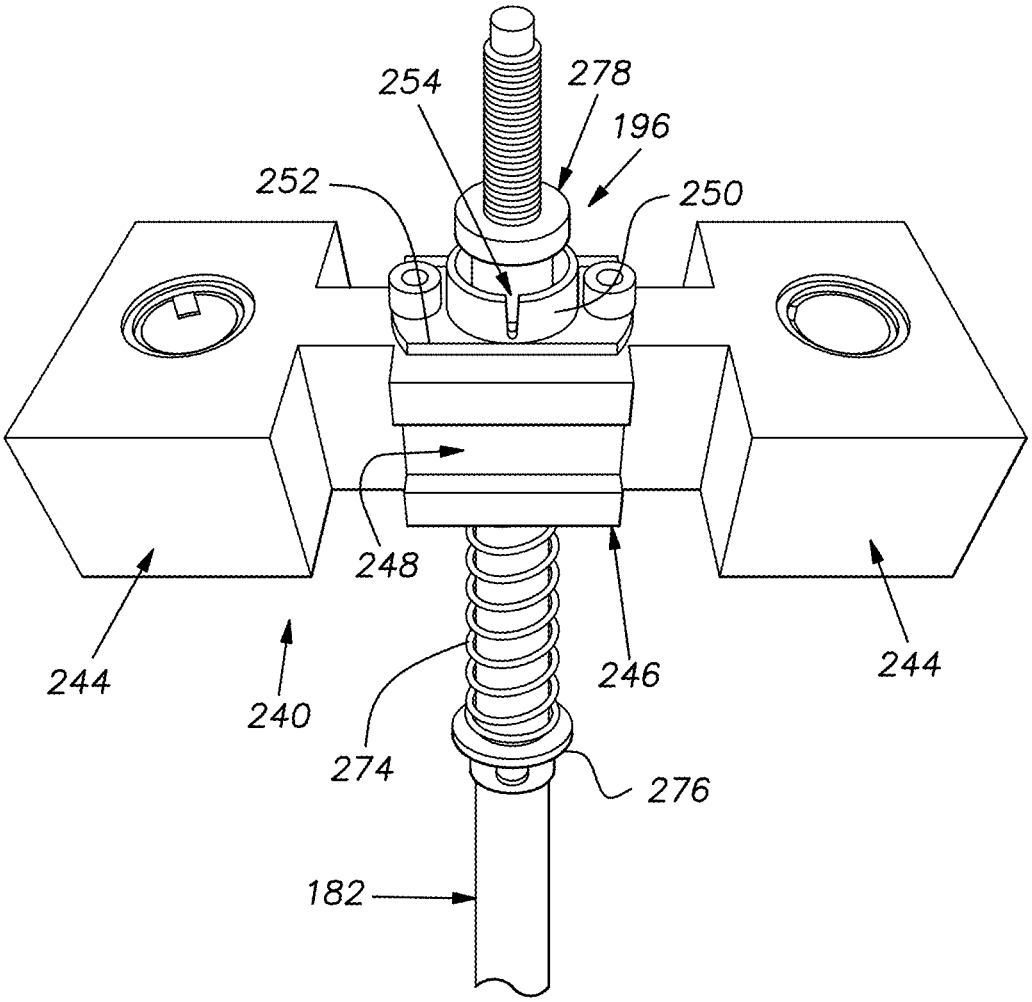
FIG. 14 shows a perspective view of a portion of an impact mass of the vacuum interrupter assembly.

Referring now to FIG. 8 and FIG. 14, the impact mass 192 is generally H-shaped and is comprised of a central structure 240 secured between a pair of outer plates 242 by screws or other fastening means. As best shown in FIG. 14, the central structure 240 is also H-shaped and includes a pair of enlarged outer blocks 244 connected to a smaller center block 246. A smooth bore extends through each outer block 244, between upper and lower faces of the outer block 244. The center block 246 also has a smooth bore extending therethrough, between upper and lower faces of the center block 246. A channel 248 is formed in a front face of the center block 246. A channel 248 is also formed in a rear face of the center block 246.

An erosion gap cylinder 250 is secured to the upper face of the center block 246. The erosion gap cylinder 250 is part of the contact erosion damper 196 and defines an interior space. The erosion gap cylinder 250 may be integrally joined to a plate 252 that is secured by screws or other fastening means to the center block 246. The erosion gap cylinder 250 has an open upper end and a lower end wall with an opening therein. The open upper end and the opening in the lower end wall are aligned with the bore in the center block 246. A notch 254 is formed in a side wall of the erosion gap cylinder 250. The notch 254 has a decreasing width from top to bottom. In the embodiment shown in FIG. 14, the notch 254 extends from an upper rim of the erosion gap cylinder 250 down to just above the plate 252 (e.g. about half a millimeter) and is substantially wedge-shaped. The erosion gap cylinder 250 (and its interior space) have a slightly inverted, frusto-conical shape, with a larger diameter at the upper rim than at the juncture with the plate 252.

The impact mass 192 is enmeshed with, but movable relative to, the shuttle 190. A portion of the center block 246 of the impact mass 192 is disposed in the central opening 226 of the body of the shuttle 190. On each side of the body of the shuttle 190, a corresponding outer block 244 is vertically disposed between the guides 234, 236 and is positioned such that its bore is aligned with the bore in the guides 234, 236. In this manner, the rails 222 extend through the outer blocks 244 of the impact mass 192, as well as the guides 234, 236 of the shuttle 190. As will be described more fully below, the impact mass 192 moves with the shuttle 190.

A pair of helical upper springs 258 are fastened between upper surfaces of the outer blocks 244 of the impact mass 192 and the upper guides 234 of the shuttle 190, respectively, with the rails 222 extending through the upper springs 258. A pair of lower springs 260 are fastened between lower surfaces of the outer blocks 244 of the impact mass 192 and the lower guides 236 of the shuttle 190, respectively, with the rails 222 extending through the lower springs 260.

Referring now to FIGS. 8 and 13, a pair of spaced-apart pawl rails 261 extend between the upper and lower rail mounts 214, 216. Upper ends of the pawl rails 261 are secured to opposing side walls of the central structure 218 of the upper rail mount 214, respectively, while lower ends of the pawl rails 261 are secured to opposing side walls of the central structure 220 of the lower rail mount 216, respectively. An upper pawl 262 and a lower pawl 264 are pivotally mounted between the pawl rails 261. Each of the upper and lower pawls 262, 264 has a catch end and an opposing release end. The catch ends 266 face each other, with the upper pawl 262 being disposed above the lower pawl 264. Each of the upper and lower pawls 262, 264 is pivotable between an engaged position, wherein the catch end is disposed in the channel 248 of the impact mass 192, and a disengaged position, wherein the catch end is disposed outward from the channel 248 of the impact mass 192. Springs 270 are connected between the upper and lower pawls 262, 264 and the pawl rails 261, respectively, and are operable to bias the upper and lower pawls 262, 264 toward their engaged positions. The springs 270 may be helical springs or leaf springs, as shown. When the shuttle 190 is in the home position, the lower pawl 264 is in the engaged position and the upper pawl 262 is in the disengaged position. When the shuttle 190 is in the uppermost position, the upper pawl 262 is in the engaged position and the lower pawl 264 is in the disengaged position.

Figure 19:
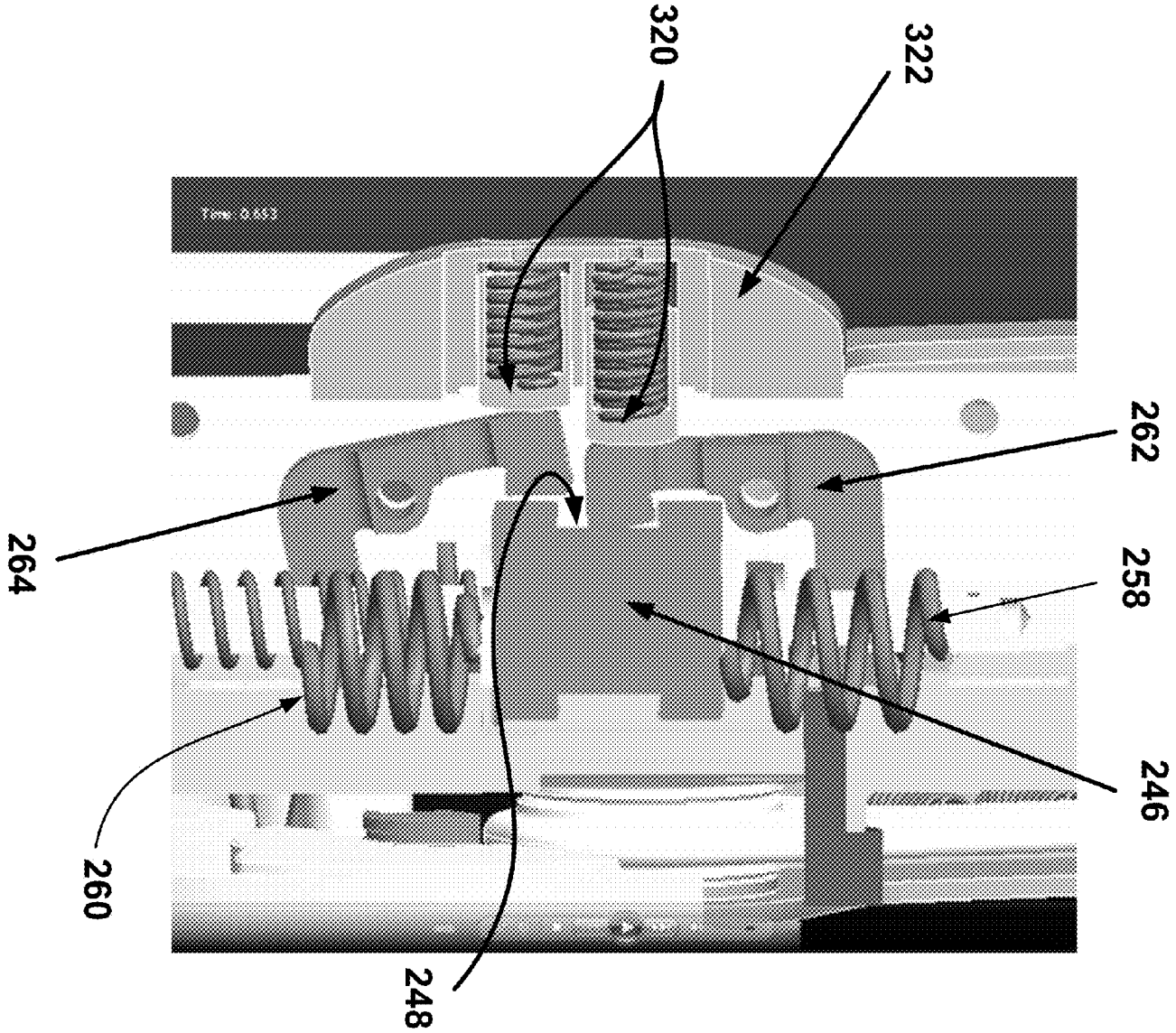
FIG. 19 shows a cross-sectional view of a portion of the second embodiment of the vacuum interrupter assembly.

With quick reference to FIGS. 19 and 20, there is shown another embodiment of the present invention having a vacuum interrupter assembly 52' with the same construction as the vacuum interrupter assembly 52, except the upper and lower pawls 262, 264 are biased by spring-loaded plungers 320 instead of the springs 270. The spring-loaded plungers 320 are mounted in a housing 322 that is secured between the pawl rails 261. The spring-loaded plungers 320 are operable to bias the upper and lower pawls 262, 264 toward their engaged positions.

With reference now to FIG. 14, the interrupter shaft 182 extends upward from the swivel 180 and passes through the bore of the center block 246 of the impact mass 192. Below the center block 246, a middle spring 274 is disposed around the interrupter shaft 182. The middle spring 274 is helical and is trapped between a plate secured to the lower face of the center block 246 and a flange 276 secured to the interrupter shaft 182. Above the center block 246, an erosion gap piston 278 is secured to the interrupter shaft 182. The erosion gap piston 278 is cylindrical and extends out radially from the interrupter shaft 182. When the contacts 164, 166 are closed, a lower portion of the erosion gap piston 278 is disposed inside the erosion gap cylinder 250 secured to the center block 246, while an upper portion of the erosion gap piston 278 is disposed above the erosion gap cylinder 250. In this regard, it should be noted that in FIG. 14, the entire erosion gap piston 278 is shown being located above the erosion gap cylinder 250. This is done only for purposes of showing the components better. With the erosion gap piston 278 partially disposed in the erosion gap cylinder 250, an erosion gap is defined between a bottom surface of the erosion gap piston 278 and the lower end wall of the erosion gap cylinder 250. The erosion gap piston 278 and the erosion gap cylinder 250 cooperate to form the contact erosion damper 196.

Figure 15:
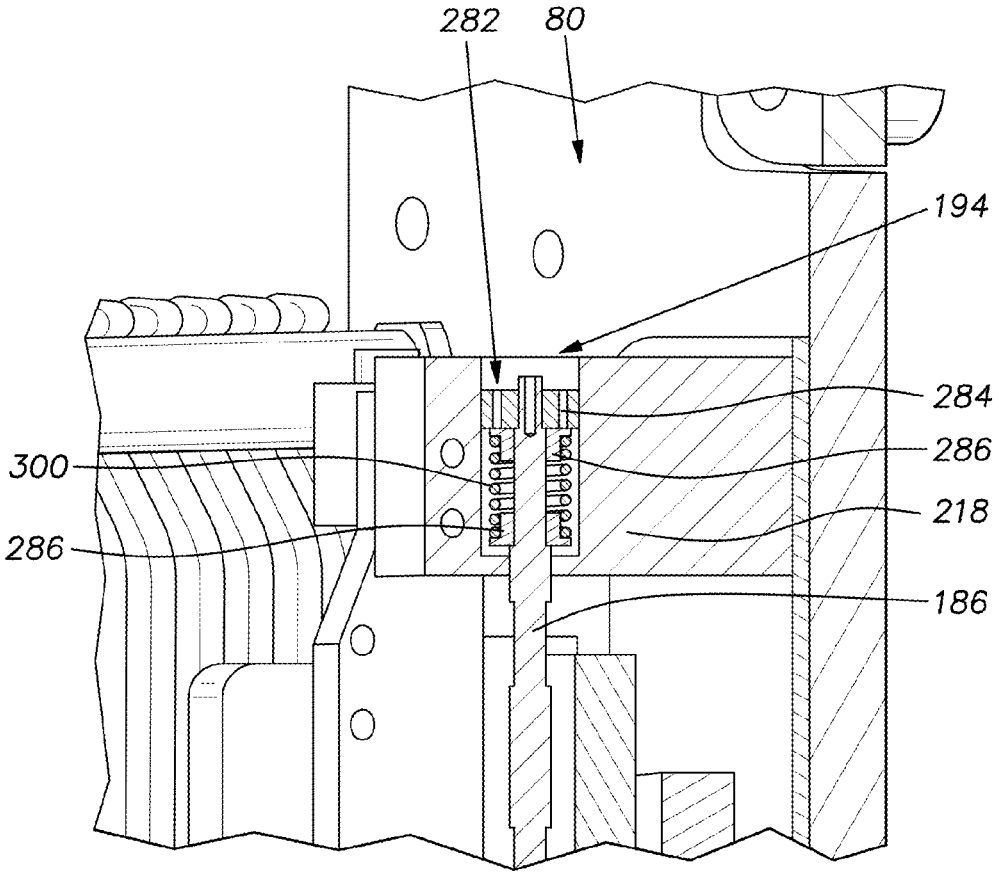
FIG. 15 shows a sectional view of a portion of the vacuum interrupter assembly showing the inside of a unidirectional damper.
Figure 16:
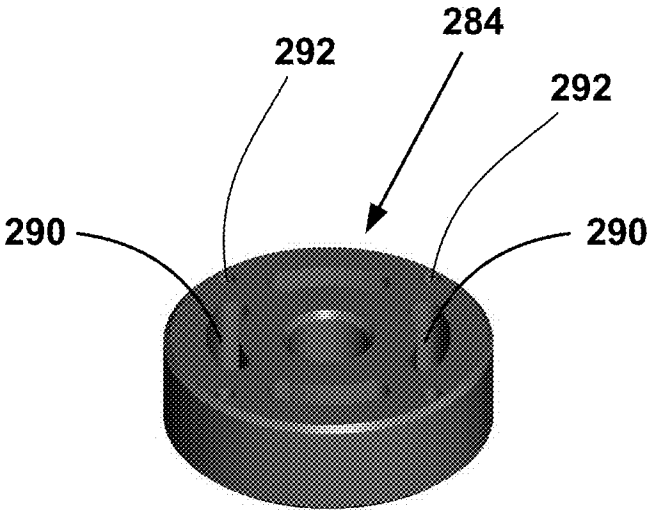
FIG. 16 shows a perspective view of a piston of the unidirectional damper.

Above the erosion gap piston 278, the interrupter shaft 182 is threadably secured to the damper shaft 186, which extends upward, into the central structure 218 of the upper rail mount 214. The central structure 218 forms a part of the unidirectional damper 194. With reference now to FIG. 15, there is shown a sectional view of the central structure 218. A cylindrical bore or chamber 282 is formed inside the central structure 218. A piston 284 and a pair of blocking structures 286 are disposed inside the chamber 282. The piston 284 is secured to an upper portion of the damper shaft 186 and is moveable therewith. As shown in FIG. 16, the piston 284 is cylindrical and has a central bore in which the damper shaft 186 is fixedly disposed. A plurality of enlarged kidney-shaped openings 290 extend through the piston 284 and are arranged in a circular configuration, around the central bore. A plurality of smaller, circular openings 292 also extend through the piston 284 and are arranged radially outward from the kidney-shaped openings 290. In the embodiment shown in FIG. 16, there are four kidney-shaped openings 290 and four circular openings 292. As will be discussed more fully below, the size and number of the kidney-shaped openings 290 and the circular openings 292 help determine the damping characteristics of the unidirectional damper 194. It should be appreciated that the openings 290, 292 may have different shapes without departing from the scope of the present invention.

Figure 17:
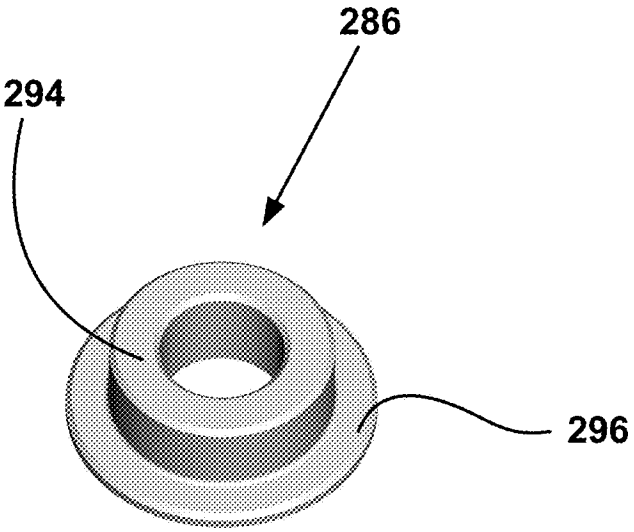
FIG. 17 shows a perspective view of a ring structure of the unidirectional damper.

As shown in FIG. 17, the blocking structures 286 each have a cylindrical body 294 with an axial bore through which the damper shaft 186 extends. An annular flange 296 is joined to the body 294 of the blocking structure 286. Both of the blocking structures 286 are movable along the damper shaft 186. A helical spring 300 is disposed around the damper shaft 186 and the bodies 294 of the blocking structures 286. The spring 300 biases the upper one of the blocking structures 286 toward a closing position, wherein the flange 296 abuts the bottom surface of the piston 284. When the flange 296 of the upper blocking structure 286 abuts the bottom surface of the piston 284, the flange 296 blocks the kidney-shaped openings 290. The circular openings 292, however, are unblocked. As will become apparent from the description below, the blocking structures 286 and the spring 300 function as a one-way check valve.

The operation of the actuation assembly will now be described. When a tap change is being made, the contacts 164, 166 of the vacuum interrupter 54 are first opened and then closed, as described above. This opening and closing is accomplished by the 360° degree rotation of the VI cam 102, which first moves the cam follower 238 and, thus, the shuttle 190 to the uppermost position and then allows the cam follower 238 and, thus the shuttle 190, to move downward to the home position, also as described above.

As the shuttle 190 moves upward to the uppermost position, the middle spring 274 and the upper and lower springs 258, 260 cause the impact mass 192 to try to follow the shuttle 190. The lower pawl 264, however, which is in the engaged position, prevents the impact mass 192 from following the shuttle 190. As a result, the lower springs 260 compress (storing compression forces) and the upper springs 258 extend. In addition, the middle spring 274 is compressed (storing compression force). When the pawl release plates 232 in the lower openings 230 of the shuttle 190 contact the release end of the lower pawl 264, they pivot the lower pawl 264 so as to move to the disengaged position, thereby releasing the impact mass 192 and all of the stored forces. The released forces cause the impact mass 192 to snap upward. As the impact mass 192 moves upward, the lower end wall of the erosion gap cylinder 250 moves up the distance of the erosion gap (i.e., eliminates the erosion gap) and contacts the erosion gap piston 278 secured to the interrupter shaft 182, thereby causing the interrupter shaft 182 to move upward. The impact mass 192 continues to move upward until it overshoots the upper pawl 262, rebounds downward and then is caught by the upper pawl 262. The upward movement of the interrupter shaft 182 moves the movable electrode 174 upward, which, in turn, opens the contacts 164, 166 of the vacuum interrupter 54. Since the stored forces of the middle spring 274 and the lower springs 260 cause the impact mass 192 to snap upward, an initially high upward force is applied to the movable contact 166, which helps break any welds that may have formed between the closed contacts 164, 166.

The upward movement of the impact mass 192 that occurs before the elimination of the erosion gap causes the middle spring 274 to extend. After the elimination of the erosion gap, the middle spring 274 stops extending. At this point, although the middle spring 274 is extended, it still stores a compression force, i.e., a pre-load.

As the shuttle 190 moves downward toward the home position, the upper and lower springs 258, 260 cause the impact mass 192 to try to follow the shuttle 190. The upper pawl 262, however, which is in the engaged position, prevents the impact mass 192 from following the shuttle 190. As a result, the upper springs 258 compress (storing compression forces) and the lower springs 260 extend. When the pawl release plates 232 in the upper openings 228 of the shuttle 190 contact the release end of the upper pawl 262, they pivot the upper pawl 262 so as to move to the disengaged position, thereby releasing the impact mass 192 and all of the stored forces. The released forces cause the impact mass 192 to snap downward. The downward movement of the impact mass 192 is conveyed through the middle spring 274 to the interrupter shaft 182 via the flange 276, causing the interrupter shaft 182 to move downward. The impact mass 192 continues to move downward until it overshoots the lower pawl 264, rebounds upward and then is caught by the lower pawl 264. The downward movement of the interrupter shaft 182 moves the movable electrode 174 downward, which, in turn, causes the contacts 164, 166 of the vacuum interrupter 54 to close.

During closing, when the contacts 164, 166 of the vacuum interrupter 54 impact against each other, the pre-load in the middle spring 274 is applied very rapidly to the closed contacts 164, 166 in a very short displacement of the impact mass 192. As the impact mass 192 continues moving downward, the middle spring 274 is further compressed, thereby bringing a small additional force to bear on the contacts 164, 166. The middle spring 274 reaches its highest compression as the asymmetry in the current peaks. This yields the highest possible spring force at the moment when the current with its corresponding blow-open force peaks. This fully compressed state occurs when the impact mass 192 is at the maximum downward overshoot of the lower pawl 264. When the impact mass 192 rebounds, the middle spring 274 extends a bit from its fully compressed position until the lower pawl 264 stops the travel of the impact mass 192. The middle spring 274, however, still provides a compression force that is applied to the closed contacts 164, 166 in this latched position. This force is in addition to the force resulting from the pressure differential across the bellows structure 176 of the vacuum interrupter 54. The additional force of the middle spring 274 helps keep the contacts 164, 166 closed during a short-circuit event. The spring force is also beneficial if a dehydrating breather gets clogged and the pressure in the tank 18 drops as a result. In that scenario the contact force resulting from the pressure differential across the bellows structure 176 will be reduced by the reduction in the pressure differential itself.

In the foregoing operation of the actuation assembly, it is important that the actuation shaft 188 move in a manner that does not damage the bellows structure 176 of the vacuum interrupter 54. In addition, the actuation shaft 188 must, on its upward or opening movement, start brusquely to separate the contacts 164, 166 (which may be welded together), but must on its downward or closing movement, travel relatively gently to avoid over-travel and damage to the vacuum interrupter 54. The unidirectional damper 194 helps achieve this carefully controlled movement. More specifically, the movement of the piston 284 (which is attached to the damper shaft 186) through dielectric fluid in the chamber 282 creates resistance (damping) that slows the movement of the actuation shaft 188. This resistance is much greater during the downward movement of the actuation shaft 188 (closing of the contacts 164, 166) than the upward movement of the actuation shaft 188 (opening of the contacts 164, 166).

When the actuation shaft 188 moves upward during the opening of the contacts 164, 166, the pressure above the piston 284 is greater than the pressure below the piston 284, which creates an opening pressure differential across the flange 296 of the upper blocking structure 286. This opening pressure differential, coupled with the inertia of the upper blocking structure 286 and its tendency to stay where it is, overcomes the bias of the spring 300 and deflects the flange 296 of the upper blocking structure 286 away from the piston 284, thereby opening the kidney-shaped openings 290 in the piston 284 and allowing dielectric fluid to pass through the kidney-shaped openings 290. Since the kidney-shaped openings 290 are large and allow dielectric fluid to pass facilely therethrough, they significantly reduce the resistance of the piston 284 moving through the dielectric fluid in the chamber 282, i.e., the damping effect of the piston 284 is small.

When the actuation shaft 188 moves downward during the closing of the contacts 164, 166, the pressure above the piston 284 is less than the pressure below the piston 284, which creates a closing pressure differential across the flange 296 of the upper blocking structure 286. This closing pressure differential, coupled with the bias of the spring 300, keeps the flange 296 of the upper blocking structure 286 pressed against the piston 284, which keeps the kidney-shaped openings 290 closed. Thus, dielectric fluid can only pass through the piston 284 via the small circular openings 292. As a result, there is significant resistance against the movement of the piston 284 through the dielectric fluid in the chamber 282, i.e., the damping effect of the piston 284 is large.

In addition to the unidirectional damper 194, the contact erosion damper 196 also modifies the movement of the actuation shaft 188. More specifically, the erosion damper 196 modifies the movement of the actuation shaft 188 to account for erosion of the contacts 164, 166. As the contacts 164, 166 erode, the position at which the contacts 164, 166 impact, within the vacuum interrupter 54, moves closer to the bottom of the vacuum interrupter 54. The contact erosion is approximately equal on both of the contacts 164, 166. Since, the bottom end of the vacuum interrupter 54 is fixed in its position, the point of interface between the two contacts 164, 166 moves downward as the contacts 164, 166 erode. Thus, for the same uppermost position of the actuation shaft 188, the upward travel distance of the actuation shaft 188 increases as the contacts 164, 166 erode due to a lower starting point. The contact erosion damper 196 permits the fixed travel distance of the impact mass 192 to accommodate this change in travel distance of the actuation shaft 188. As described above, an erosion gap is formed between the lower end wall of the erosion gap cylinder 250 and the erosion gap piston 278 when the contacts 164, 166 are closed. This erosion gap becomes smaller as the contacts 164, 166 erode because the actuation shaft 188 and the erosion gap piston 278 progressively move downward, toward the erosion gap cylinder 250, as the contacts 164, 166 erode due to the point of interface between the contacts 164, 166 moving downward. Since the erosion gap becomes smaller, the erosion gap cylinder 250 contacts the erosion gap piston 278 sooner as the contacts 164, 166 erode. Thus, the impact mass 192 moves the actuation shaft 188 sooner as the contacts 164, 166 erode, which permits the impact mass 192 to move the actuation shaft 188 farther during its travel.

The configuration of the erosion gap cylinder 250 and the progressively decreasing size of the notch 254 in the erosion gap cylinder 250 help extend the life of the vacuum interrupter 54. The larger diameter of the erosion gap cylinder 250 and the larger width of the notch 254 toward the top of the erosion gap cylinder 250 permit dielectric fluid to readily escape the erosion gap cylinder 250 as the erosion gap cylinder 250 initially starts to move upward, toward the erosion gap piston 278. This prevents the dielectric fluid in the erosion gap cylinder 250 from compressing, which keeps the initial relative motion between the erosion gap piston 278 and erosion gap cylinder 250 from opening the contacts 164, 166 prematurely with an inadequate speed. As the position of the bottom of the erosion gap piston 278 relative to the erosion gap cylinder 250 arrives at the bottom of the notch 254, the dielectric fluid remaining in the erosion gap cylinder 250 becomes compressed. Without in any way intending to limit the scope of the present invention or being limited to any particular theory, it is believed that the force from this compression of the dielectric fluid may eliminate clearances of loose parts within the actuation shaft 188, such as at the shoulder bolt connecting the interrupter shaft 182 to the swivel 180. Also, dielectric fluid trapped between the bottom of the erosion gap piston 278 and the lower end wall of the erosion gap cylinder 250 may act as a shock absorber between the erosion gap cylinder 250 and erosion gap piston 278.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. An on-load tap changer, comprising:

a vacuum interrupter assembly for immersion in a dielectric fluid, the vacuum interrupter assembly comprising:

a vacuum interrupter with contacts;

a rotatable cam;

a shaft connected to the contacts of the vacuum interrupter and operable upon movement to open and close the contacts, the shaft being movable between a first position, corresponding to a closed position of the contacts, and a second position, corresponding to an open position of the contacts;

a shuttle having a cam follower engaged with the cam such that rotation of the cam moves the shuttle;

an impact mass with a containment structure, the impact mass being connected to the shuttle by first and second springs such that the impact mass tends to follow the shuttle when the shuttle moves, the containment structure having least one side wall with an opening therein and an end wall with a hole through which the shaft extends;

a holding device operable to hold and then release the impact mass when the shuttle starts to move, the holding of the impact mass when the shuttle starts to move causing one of the first and second springs to extend and the other one of the first and second springs to compress and store a compression force, which is released when the impact mass is released, the movement of the impact mass moving the shaft to open or close the contacts;

a piston secured to the shaft, the piston being separated from the end wall of the containment structure by a gap distance when the shaft is in the first position; and wherein when the shaft is in the first position and the impact mass moves as a result of the movement of the shuttle, the impact mass moves about the gap distance before the movement of the end wall of the containment structure is transferred to the piston so as to cause the shaft to move in the direction of the impact mass.

2. The on-load tap changer of claim 1, wherein the shuttle is movable between a first position, corresponding to a closed position of the contacts, and a second position, corresponding to an open position of the contacts;

wherein when the shuttle starts to move to the second position and the impact mass is being held, the first spring compresses and the second spring extends; and wherein when the shuttle starts to move to the first position and the impact mass is being held, the first spring extends and the second spring compresses.

3. The on-load tap changer of claim 2, further comprising a third spring and a fourth spring; and wherein when the shuttle starts to move to the second position and the impact mass is being held, the third spring compresses and the fourth spring extends; and wherein when the shuttle starts to move to the first position and the impact mass is being held, the third spring extends and the fourth spring compresses.

4. The on-load tap changer of claim 3, wherein each of the springs is helical.

5. The on-load tap changer of claim 1, wherein the containment structure is generally curvilinear;

wherein the impact mass has a bore extending therethrough; and wherein the containment structure is secured to the impact mass such that the opening in the containment structure is aligned with the bore in the impact mass.

6. The on-load tap changer of claim 5, wherein the containment structure is generally cylindrical.

7. The on-load tap changer of claim 6, wherein the diameter at a first end of the containment structure is greater than at a second end of the containment structure.

8. The on-load tap changer of claim 6, wherein the opening is a V-shaped notch.

9. The on-load tap changer of claim 8, wherein the containment structure has an open upper end defined by a rim, and wherein the notch extends from the rim down to a nadir just above the end wall, with the notch tapering inward from the rim to the nadir.

10. The on-load tap changer of claim 1, wherein the shaft has a flange secured thereto; and wherein the on-load tap changer further comprises a third spring disposed around the shaft, between the impact mass and the flange on the shaft, the third spring extending when the impact mass is released to move in a direction to open the contacts.

11. The on-load tap changer of claim 1, wherein the containment structure comprises a cylinder secured to a top surface of the impact mass, the cylinder including the at least one side wall and the end wall.

12. An on-load tap changer, comprising:

a vacuum interrupter assembly for immersion in a dielectric fluid, the vacuum interrupter assembly comprising:

a vacuum interrupter with contacts;

a rotatable cam;

a shaft connected to the contacts of the vacuum interrupter and operable upon movement to open and close the contacts;

a shuttle having a cam follower engaged with the cam such that rotation of the cam moves the shuttle between a first position, corresponding to a closed position of the contacts, and a second position, corresponding to an open position of the contacts;

an impact mass connected to the shuttle by first and second springs such that the impact mass tends to follow the shuttle when the shuttle moves;

a holding device operable to hold and then release the impact mass when the shuttle starts to move, the holding of the impact mass when the shuttle starts to move causing one of the first and second springs to extend and the other one of the first and second springs to compress and store a compression force, which is released when the impact mass is released, the movement of the impact mass moving the shaft to open or close the contacts, the holding device comprising:

first and second pawls pivotally mounted between a pair of pawl rails, each of the first and second pawls comprising a catch end and a release end, the first and second pawls being arranged in the direction of the first and second positions of the shuttle and such that their catch ends face each other, wherein each of the first and second pawls is pivotable between an engaged position, wherein the catch end engages the impact mass so as to prevent its movement, and a disengaged position, wherein the catch end does not engage the impact mass, the first pawl being in the engaged position when the shuttle is in the first position, and the second pawl being in the engaged position when the shuttle is in the second position; and springs biasing the first and second pawls toward their engaged positions, respectively; and wherein the shuttle comprises a main body having at least one first opening and at least one second opening, the at least one first opening and the at least one second opening being arranged in the direction of the first and second positions of the shuttle;

wherein a pawl release plate is mounted inside each of the at least one first opening and the at least one second opening;

wherein when the shuttle moves from the first position to the second position, the pawl release plate in the at least one first opening contacts the release end of the first pawl, thereby causing the first pawl to pivot to the disengaged position; and wherein when the shuttle moves from the second position to the first position, the pawl release plate in the at least one second opening contacts the release end of the second pawl, thereby causing the second pawl to pivot to the disengaged position.

13. The on-load tap changer of claim 12, wherein the shuttle further comprises a pair of first mounts joined to opposing sides of the main body, respectively, and a pair of second mounts joined to opposing sides of the main body, respectively, each of the first mounts and the second mounts having a bore extending therethrough; and wherein the vacuum interrupter assembly further comprises a pair of spaced-apart mounting rails, one of the mounting rails extending through the bores of one of the first mounts and one of the second mounts, and the other one of the mounting rails extending through the bores of the other one of the first mounts and the other one of the second mounts.

14. The on-load tap changer of claim 13, wherein the impact mass comprises a pair of blocks, each of which has opposing first and second surfaces and a bore extending therethrough; and wherein the mounting rails extend through the bores in the blocks, respectively.

15. The on-load tap changer of claim 14, further comprising a third spring and a fourth spring;

wherein the first and third springs are disposed between the first surfaces of the blocks of the impact mass and the first mounts of the shuttle, respectively; and wherein the second and fourth springs are disposed between the second surfaces of the blocks of the impact mass and the second mounts of the shuttle, respectively.

16. The on-load tap changer of claim 14, wherein the impact mass further comprises a center structure joined between the blocks, the center structure having a channel formed therein; and wherein for each of the first and second pawls, the catch end is disposed in the channel when the first or second pawl is in the engaged position.

17. An on-load tap changer, comprising:

a vacuum interrupter assembly for immersion in a dielectric fluid, the vacuum interrupter assembly comprising:

a vacuum interrupter with contacts;

a rotatable cam;

a shaft connected to the contacts of the vacuum interrupter and operable upon movement to open and close the contacts;

a shuttle having a cam follower engaged with the cam such that rotation of the cam moves the shuttle;

an impact mass connected to the shuttle by first and second springs such that the impact mass tends to follow the shuttle when the shuttle moves;

a holding device operable to hold and then release the impact mass when the shuttle starts to move, the holding of the impact mass when the shuttle starts to move causing one of the first and second springs to extend and the other one of the first and second springs to compress and store a compression force, which is released when the impact mass is released, the movement of the impact mass moving the shaft to open or close the contacts; and a damper operable to dampen the movement of the shaft, the damper providing more dampening when the shaft is closing the contacts of the vacuum interrupter than when the shaft is opening the contacts of the vacuum interrupter;

wherein the damper comprises: a housing at least partially defining an interior chamber into which the shaft extends;

a piston disposed in the interior chamber and secured to the shaft so as to be movable therewith, the piston having openings extending therethrough; and a valve operable to block the openings in the piston when the shaft is closing the contacts of the vacuum interrupter and to un-block the openings in the piston when the shaft is opening the contacts of the vacuum interrupter.

18. The on-load tap changer of claim 17, further comprising a third spring and a fourth spring;

wherein the shuttle is movable between a first position, corresponding to a closed position of the contacts, and a second position, corresponding to an open position of the contacts;

wherein when the shuttle starts to move to the second position and the impact mass is being held, the first spring and the third spring compress and the second spring and the fourth spring extend; and wherein when the shuttle starts to move to the first position and the impact mass is being held, the first spring and the third spring extend and the second spring and the fourth spring compress.

* * * * *